US009038715B2

(12) United States Patent
Smith, Jr. et al.

(10) Patent No.: US 9,038,715 B2
(45) Date of Patent: May 26, 2015

(54) USE OF PNC TOOLS TO DETERMINE THE DEPTH AND RELATIVE LOCATION OF PROPPANT IN FRACTURES AND THE NEAR BOREHOLE REGION

(75) Inventors: Harry D. Smith, Jr., Montgomery, TX (US); Xiaogang Han, Tomball, TX (US); Robert Duenckel, Southlake, TX (US)

(73) Assignee: CARBO CERAMICS, Houston, TX (US)

( * ) Notice: Subject to any disclaimer, the term of this patent is extended or adjusted under 35 U.S.C. 154(b) by 430 days.

(21) Appl. No.: 13/461,498

(22) Filed: May 1, 2012

(65) Prior Publication Data

US 2013/0292109 A1 Nov. 7, 2013

(51) Int. Cl.

| | |
|---|---|
| ***E21B 47/09*** | (2012.01) |
| ***E21B 43/04*** | (2006.01) |
| ***E21B 43/267*** | (2006.01) |
| ***E21B 47/10*** | (2012.01) |

(52) U.S. Cl.

CPC ..... *E21B 43/04* (2013.01); *E21B 43/267* (2013.01); *E21B 47/1015* (2013.01)

(58) Field of Classification Search

CPC ..... E21B 47/1015
USPC ..... 166/250.01, 250.12, 254.2; 250/269.5
See application file for complete search history.

(56) References Cited

U.S. PATENT DOCUMENTS

| | | | |
|---|---|---|---|
| 3,240,938 | A | 3/1966 | Hall, Jr. |
| 3,492,147 | A | 1/1970 | Young et al. |
| 3,929,191 | A | 12/1975 | Graham et al. |
| 3,943,362 | A | 3/1976 | Peelman |
| 4,021,666 | A | 5/1977 | Allen |
| 4,052,613 | A | 10/1977 | Murphy et al. |
| 4,068,718 | A | 1/1978 | Cooke, Jr. et al. |
| 4,078,174 | A | 3/1978 | Goldman |

(Continued)

FOREIGN PATENT DOCUMENTS

| | | |
|---|---|---|
| CN | 102007267 | 4/2011 |
| WO | WO 2005/103446 | 11/2005 |

(Continued)

OTHER PUBLICATIONS

International Search Report and Written opinion issued for PCT/US13/37979, dated Aug. 8, 2013, 16 pgs.

(Continued)

*Primary Examiner* — Jennifer H Gay
*Assistant Examiner* — Steven MacDonald
(74) *Attorney, Agent, or Firm* — Haynes and Boone, LLP

(57) ABSTRACT

Methods are provided for identifying the location and height of induced subterranean formation fractures and the presence of any associated frac-pack or gravel pack material in the vicinity of the borehole using pulsed neutron capture (PNC) logging tools. The proppant/sand used in the fracturing and packing processes is tagged with a thermal neutron absorbing material. When proppant is present, increases in detected PNC formation and/or borehole component cross-sections, combined with decreases in measured count rates, are used to determine the location of the formation fractures and the presence and percent fill of pack material in the borehole region. Changes in measured formation cross-sections relative to changes in other PNC parameters provide a relative indication of the proppant in fractures compared to that in the borehole region.

56 Claims, 12 Drawing Sheets

(56) References Cited

U.S. PATENT DOCUMENTS

| | | | | |
|---|---|---|---|---|
| 4,092,536 | A | 5/1978 | Smith | |
| 4,288,696 | A | 9/1981 | Peelman et al. | |
| 4,427,068 | A | 1/1984 | Fitzgibbon | |
| 4,440,866 | A | 4/1984 | Lunghofer et al. | |
| 4,495,604 | A | 1/1985 | Clavier et al. | |
| 4,585,064 | A | 4/1986 | Graham et al. | |
| 4,642,460 | A | 2/1987 | Wallace | |
| 4,658,899 | A | 4/1987 | Fitzgibbon | |
| 4,731,531 | A | 3/1988 | Handke | |
| 4,760,252 | A | 7/1988 | Albats et al. | |
| 4,825,073 | A | 4/1989 | Smith, Jr. et al. | |
| 4,879,181 | A | 11/1989 | Fitzgibbon | |
| 4,894,285 | A | 1/1990 | Fitzgibbon | |
| 4,926,940 | A | 5/1990 | Stromswold | |
| 5,156,804 | A | 10/1992 | Halverson et al. | |
| 5,243,190 | A * | 9/1993 | Bandy et al. | 250/260 |
| 5,322,126 | A | 6/1994 | Scott, III | |
| 5,404,010 | A | 4/1995 | Anderson et al. | |
| 5,410,152 | A | 4/1995 | Gadeken | |
| 5,441,110 | A | 8/1995 | Scott, III | |
| 5,536,938 | A | 7/1996 | Mills et al. | |
| 5,572,021 | A | 11/1996 | Heathman et al. | |
| 5,635,712 | A | 6/1997 | Scott, III et al. | |
| 6,207,953 | B1 | 3/2001 | Wilson | |
| 6,389,367 | B1 | 5/2002 | Plasek | |
| 6,725,926 | B2 | 4/2004 | Nguyen et al. | |
| 6,815,665 | B2 | 11/2004 | Storm et al. | |
| 7,036,591 | B2 | 5/2006 | Cannan et al. | |
| 8,100,177 | B2 | 1/2012 | Smith, Jr. | |
| 2006/0192096 | A1 | 8/2006 | Radtke | |
| 2007/0011115 | A1 | 1/2007 | Smith, Jr. et al. | |
| 2007/0034373 | A1 | 2/2007 | McDaniel et al. | |
| 2008/0009425 | A1 | 1/2008 | Pershikova | |
| 2009/0205825 | A1 | 8/2009 | Smith et al. | |
| 2009/0210161 | A1 | 8/2009 | Duenckel et al. | |
| 2009/0224146 | A1 | 9/2009 | Gilchrist et al. | |
| 2011/0001040 | A1 | 1/2011 | Smith, Jr. et al. | |
| 2011/0272146 | A1 | 11/2011 | Green et al. | |
| 2011/0297818 | A1 * | 12/2011 | Thornton | 250/269.5 |

FOREIGN PATENT DOCUMENTS

| | | |
|---|---|---|
| WO | WO 2007/019585 | 2/2007 |
| WO | WO 2009/105306 | 8/2007 |
| WO | WO 2010/120494 | 10/2010 |
| WO | WO 2011/162938 | 12/2011 |

OTHER PUBLICATIONS

International Search Report mailed Jun. 1, 2010, by the ISA/US, in connection with International Application No. PCT/US2010/029207.

International Search Report mailed Feb. 27, 2009, by the ISA/US, in connection with International Application No. PCT/US2009/031878.

Written Opinion mailed Feb. 27, 2009, by the ISA/US, in connection with International Application No. PCT/US2009/031878.

International Preliminary Report on Patentability mailed Sep. 8, 2010, by the IPEA/US, in connection with International Application No. PCT/US2009/031878.

International Search Report mailed Sep. 16, 2011, by the ISA/US, in connection with International Application No. PCT/US2011/039236.

Written Opinion mailed Sep. 16, 2011, by the ISA/US, in connection with International Application No. PCT/US2011/039236.

Office Action mailed Aug. 31, 2010, by the USPTO, in connection with U.S. Appl. No. 12/358,168.

Office Action mailed Apr. 8, 2011, by the USPTO, in connection with U.S. Appl. No. 12/358,168.

Notice of Allowance mailed Sep. 27, 2011, by the USPTO, in connection with U.S. Appl. No. 12/358,168.

Office Action mailed Nov. 28, 2011, by the USPTO, in connection with U.S. Appl. No. 12/425,884.

Examiner Interview Summary mailed Mar. 20, 2012, by the USPTO, in connection with U.S. Appl. No. 12/425,884.

Correspondence from foreign counsel regarding Office Action dated Dec. 14, 2011, issued by the Eurasian Patent Office, regarding Eurasian Patent App No. 201001336.

W.E. Schultz et al.; *Experimental Basis for a New Borehole Corrected Pulsed Neutron Capture Logging System* (*TMD*); SPWLA Publications.

H.D Smith, Jr. et al.; *Applications of a New Borehole Corrected Pulsed Neutron Capture Logging System* (*TMD*); SPWLA Publications.

J.C. Buchanan et al.; *Applications of TMD* Pulsed Neutron Logs in Unusual Downhole Logging Environments*; SPWLA Publications.

Neutron activation analysis; Wikipedia, 6 pages.

Office action mailed Dec. 7, 2011, by USPTO in connection with U.S. Appl. No. 12/820,576.

Mark Mulkern et al, *A Green Alternative for Determination of Frac Height and Proppant Distribution*, SPE 138500, Oct. 12-14, 2010, 9 pages, SPE Eastern Regional Meeting held in Morgantown, West Virginia.

* cited by examiner

CASE 1: BEFORE-FRAC
CASE 2: AFTER-FRAC (0.4% $Gd_2O_3$ IN PROPPANT)
CASE 3: AFTER-FRAC...FRAC SLURRY IN FRACTURE AND IN 20% OF THE VOLUME OF THE CEMENT REGION
CASE 4: AFTER-FRAC...NO FRAC SLURRY IN FRACTURE, BUT FRAC SLURRY IN 20% OF THE VOLUME OF THE CEMENT REGION

MONTE CARLO (MCNP) FRAC-PACK GEOMETRY - TOP VIEW, FRAC-PACK CASE 3 IN FIGURE 7 (NOT TO SCALE WITH FIGURE 7). TAGGED PROPPANT IS PRESENT IN BOTH THE ANNULUS BETWEEN THE SCREEN AND WELL CASING AND IN THE FRACTURE ZONE OUTSIDE THE CASING

SIMULATED LOG OF FORMATION AND BOREHOLE SIGMA VALUES AND GATED CAPTURE GAMMA RAY COUNTS IN THE MODELED FRAC-PACK CASES IN FIG.7

FRAC-PACK CASE 1 = BASELINE (NO PACK MATERIAL IN ANNULUS OR FRACTURE)
FRAC-PACK CASE 2 = PACK MATERIAL ONLY IN ANNULUS BETWEEN CASING AND LINER
FRAC-PACK CASE 3 = PACK MATERIAL IN ANNULUS AND FRACTURE

Fig. 11 MODELED GEOMETRY FOR A FRAC, FRAC-PACK, OR GRAVEL PACK IN A HORIZONTAL WELL WITH AN UNCEMENTED LINER/SCREEN

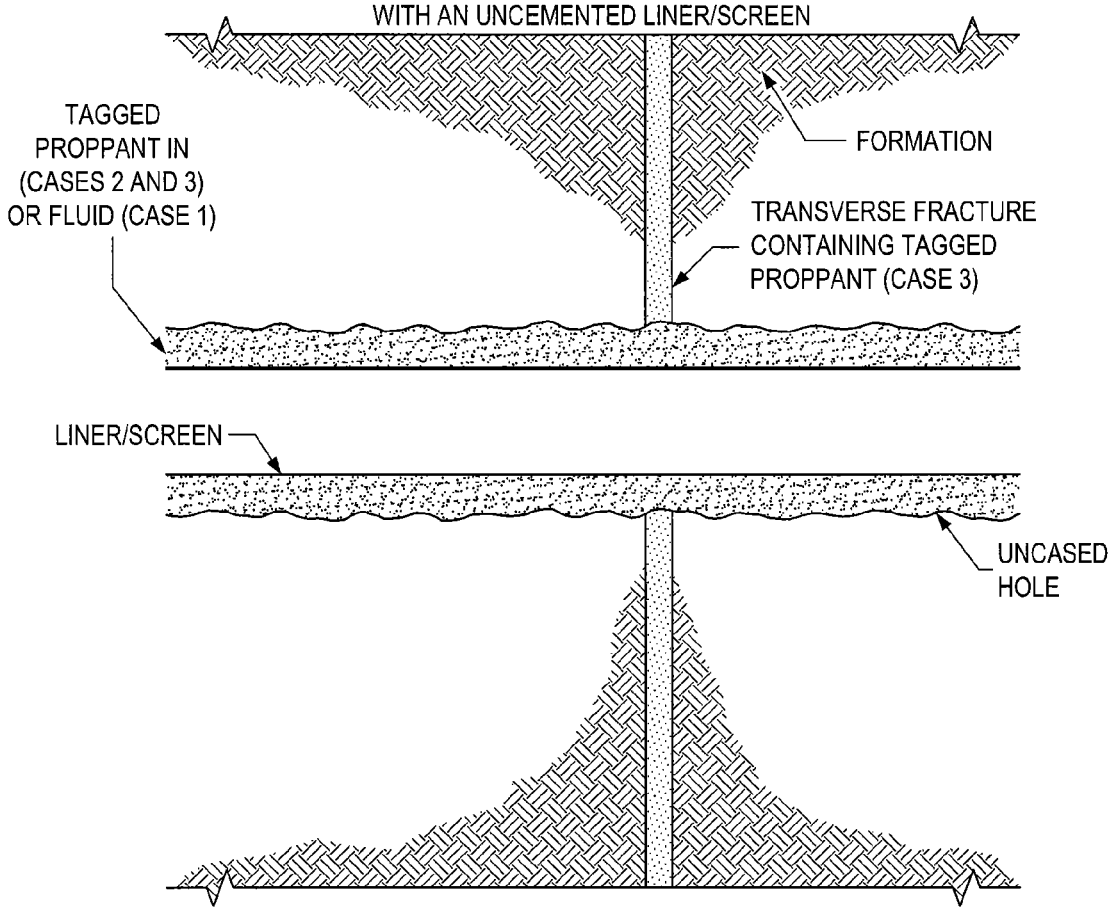

HORIZONTAL CASE 1 = BASELINE (NO PACK MATERIAL IN LINER/SCREEN ANNULUS OR FRACTURE)
HORIZONTAL CASE 2 = PACK MATERIAL ONLY IN BOREHOLE-LINER/SCREEN ANNULUS
HORIZONTAL CASE 3 = PACK MATERIAL IN ANNULUS AND VERTICAL FRACTURE
(FRACTURE PLANE IS PERPENDICULAR TO BOREHOLE AXIS)

USE OF PNC TOOLS TO DETERMINE THE DEPTH AND RELATIVE LOCATION OF PROPPANT IN FRACTURES AND THE NEAR BOREHOLE REGION

BACKGROUND

The present invention relates to hydraulic fracturing operations, and more specifically to methods for identifying an induced subterranean formation fracture and any associated frac-pack or gravel pack material in the vicinity of the borehole using pulsed neutron capture (PNC) logging tools In order to more effectively produce hydrocarbons from downhole formations, and especially in formations with low porosity and/or low permeability, induced fracturing (called "frac operations", "hydraulic fracturing", or simply "fracing") of the hydrocarbon-bearing formations has been a commonly used technique. In a typical frac operation, fluids are pumped downhole under high pressure, causing the formations to fracture around the borehole, creating high permeability conduits that promote the flow of the hydrocarbons into the borehole. These frac operations can be conducted in horizontal and deviated, as well as vertical, boreholes, and in either intervals of uncased wells, or in cased wells through perforations. In some frac operations, frac material, including proppant or sand, is packed not only in a fractured region outside the casing in the well, but is also packed into the annular space between the casing and a liner inside the casing in a so-called cased-hole frac-pack. In some other situations in an uncased wellbore, in a so-called open-hole frac pack, frac material is placed outside a perforated liner or a screen in the region around the liner/screen, and also out into induced fractures in the formation. In yet other situations in cased holes, frac material is placed only in the annular space between the casing and an interior screen or perforated liner, in a so-called gravel-pack. In yet other situations in cased holes, frac material is placed only in the annular space between the casing and an interior screen or liner, in a so-called gravel-pack. In some other situations in an uncased wellbore, in a so-called open-hole fracturing, frac-packing, or gravel packing operation, frac material is placed outside a perforated liner or a screen. In open-hole fracturing and frac-packing, frac material is also placed out into induced fractures in the formation. In all of these situations, it is desired to know where the packing material has been placed, and also where it has not been placed.

In cased boreholes in vertical wells, for example, the high pressure fluids exit the borehole via perforations through the casing and surrounding cement, and cause the formations to fracture, usually in thin, generally vertical sheet-like fractures in the deeper formations in which oil and gas are commonly found. These induced fractures generally extend laterally a considerable distance out from the wellbore into the surrounding formations, and extend vertically until the fracture reaches a formation that is not easily fractured above and/or below the desired frac interval. The directions of maximum and minimum horizontal stress within the formation determine the azimuthal orientation of the induced fractures. Normally, if the fluid, sometimes called slurry, pumped downhole does not contain solids that remain lodged in the fracture when the fluid pressure is relaxed, then the fracture re-closes, and most of the permeability conduit gain is lost.

These solids, called proppants, are generally composed of sand grains or ceramic particles, and the fluid used to pump these solids downhole is usually designed to be sufficiently viscous such that the proppant particles remain entrained in the fluid as it moves downhole and out into the induced fractures. Prior to producing the fractured formations, materials called "breakers", which are also pumped downhole in the frac fluid slurry, reduce the viscosity of the frac fluid after a desired time delay, enabling these fluids to be easily removed from the fractures during production, leaving the proppant particles in place in the induced fractures to keep them from closing and thereby substantially precluding production fluid flow therethrough.

In frac-pack or gravel-pack operations, the proppants are placed in the annular space between well casing and an interior screen or liner in a cased-hole frac pack or gravel pack, and/or in an annular space in the wellbore outside a screen or liner in open-hole fracturing, frac-packing, or gravel packing operations. Pack materials are primarily used to filter out solids being produced along with the formation fluids in oil and gas well production operations. This filtration assists in preventing these sand or other particles from being produced with the desired fluids into the borehole and to the surface. Such undesired particles might otherwise damage well and surface tubulars and complicate fluid separation procedures due to the erosive nature of such particles as the well fluids are flowing.

The proppants may also be placed in the induced fractures with a low viscosity fluid in fracturing operations referred to as "water fracs". The fracturing fluid in water fracs is water with little or no polymer or other additives. Water fracs are advantageous because of the lower cost of the fluid used. Also when using cross-linked polymers, it is essential that the breakers be effective or the fluid cannot be recovered from the fracture effectively restricting flow of formation fluids. Water fracs, because the fluid is not cross-linked, do not rely on effectiveness of breakers.

Proppants commonly used are naturally occurring sands, resin coated sands, and ceramic proppants. Ceramic proppants are typically manufactured from naturally occurring materials such as kaolin and bauxitic clays, and offer a number of advantages compared to sands or resin coated sands principally resulting from the compressive strength of the manufactured ceramics and their highly spherical particle configuration.

Although induced fracturing, frac-packing, and gravel-packing have been highly effective tools in the production of hydrocarbon reservoirs, there is nevertheless usually a need to determine the interval(s) that have been fractured after the completion of the frac operation, and in packing operations, the intervals in the borehole region that have been adequately packed. It is possible that there are zones within the desired fracture interval(s) which were ineffectively fractured or packed, either due to anomalies within the formation or problems within the borehole, such as ineffective or blocked perforations or gravity segregation of pack material solids. It is also desirable to know if the fractures extend vertically across the entire desired fracture interval(s), and also to know whether or not any fracture(s) may have extended vertically outside the desired interval. In the latter case, if the fracture has extended into a water-bearing zone, the resulting water production would be highly undesirable. In all of these situations, knowledge of the location of both the fractured and unfractured zones would be very useful for planning remedial operations in the subject well and/or in utilizing the information gained for planning frac jobs on future candidate wells.

There have been several methods used in the past to help locate the successfully fractured and packed intervals and the extent of the fractures in frac operations. For example, acoustic well logs have been used. Acoustic well logs are sensitive to the presence of fractures, since fractures affect the velocities and magnitudes of compressional and shear acoustic waves traveling in the formation. However, these logs are also affected by many other parameters, such as rock type, formation porosity, pore geometry, borehole conditions, and presence of natural fractures in the formation. Another previously utilized acoustic-based fracture detection technology is the use of "crack noise", wherein an acoustic transducer placed downhole immediately following the frac job actually "listens" for signals emanating from the fractures as they close after the frac pressure has been relaxed. This technique has had only limited success due to: (1) the logistical and mechanical problems associated with having to have the sensor(s) in place during the frac operation, since the sensor has to be activated almost immediately after the frac operation is terminated, and (2) the technique utilizes the sound generated as fractures close, therefore effective fractures, which are the ones that have been propped open to prevent closure thereof, often do not generate noise signals as easy to detect as the signals from unpropped fractures, which can generate misleading results.

Arrays of tilt meters at the surface have also been previously utilized to determine the presence of subterranean fractures. These sensors can detect very minute changes in the contours of the earth's surface above formations as they are being fractured, and these changes across the array can often be interpreted to locate fractured intervals. This technique is very expensive to implement, and does not generally have the vertical resolution to be able to identify which zones within the frac interval have been fractured and which zones have not, nor can this method effectively determine if the fracture has extended vertically outside the desired vertical fracture interval(s).

Microseismic tools have also been previously utilized to map fracture locations and geometries. In this fracture location method, a microseismic array is placed in an offset well near the well that is to be hydraulically fractured. During the frac operations the microseismic tool records microseisms that result from the fracturing operation. By mapping the locations of the mictoseisms it is possible to estimate the height and length of the induced fracture. However, this process is expensive and requires a nearby available offset well.

Other types of previously utilized fracture location detection techniques employ nuclear logging methods. A first such nuclear logging method uses radioactive materials which are mixed at the well site with the proppant and/or the frac fluid just prior to the proppant and/or frac fluid being pumped into the well. After such pumping, a logging tool is moved through the wellbore to detect and record gamma rays emitted from the radioactive material previously placed downhole, the recorded radioactivity-related data being appropriately interpreted to detect the fracture locations. A second previously utilized nuclear logging method is performed by pumping one or more stable isotopes downhole with the proppant in the frac slurry, such isotope material being capable of being activated (i.e., made radioactive) by a neutron-emitting portion of a logging tool run downhole after the fracing process. A spectroscopic gamma ray detector portion of the tool detects and records gamma rays from the resulting decay of the previously activated "tracer" material nuclei as the tool is moved past the activated material. The gamma spectra are subsequently analyzed to identify the activated nuclei, and thus the frac zones. One or both of these previously utilized nuclear-based techniques for locating subterranean fractures has several known limitations and disadvantages which include:

1. The need to pump radioactive material downhole or to create radioactivity downhole by activating previously non-radioactive material within the well;
2. A requirement for complex and/or high resolution gamma ray spectroscopy detectors and spectral data analysis methods;
3. Undesirably shallow depth of fracture investigation capability;
4. Possible hazards resulting from flowback to the surface of radioactive proppants or fluids;
5. Potential for radioactivity contamination of equipment at the well site;
6. The need to prepare the proppant at the well site to avoid an undesirable amount of radioactive decay of proppant materials prior to performance of well logging procedures;
7. The possibility of having excess radioactive material on the surface which cannot be used at another well;
8. The requirement for specialized logging tools which are undesirably expensive to run;
9. The requirement for undesirably slow logging tool movement speeds through the wellbore; and
10. The need for sophisticated gamma ray spectral deconvolution or other complex data processing procedures.

In the case of frac-pack and gravel-pack operations, a variety of methods have been suggested for detecting pack material located in the borehole region. Most of these methods are based on the use of nuclear logging tools with either gamma ray sources or continuous chemical neutron sources, and containing gamma ray or thermal neutron detectors, and are described in U.S. Pat. No. 6,815,665, the entire disclosure of which is incorporated herein by reference. However in all cases these methods are specifically designed to detect pack material inside the well casing, and to exclude to the degree possible the detection of proppant/sand outside the casing, including any material packed into fractures in the formation. Further, to the present applicants' knowledge, in none of these methods has there been any effort to determine the relative signal from proppant/sand packed into the borehole region relative to material packed into the formation and fractures outside the wellbore, which is vital information in evaluating both conventional fracturing and frac-packing operations. U.S. Pat. No. 8,100,177, issued to inventors of this patent application and the disclosure of which is incorporated herein by reference, discusses recent induced fracture detection methods using compensated and pulsed neutron logging technologies, and provides pulsed-neutron methods to detect downhole proppant signals from both formation and borehole regions, but does not discuss methods to distinguish the pack material located in formation fractures from pack material in the borehole region in frac-packs or gravel-packs.

As can be seen from the foregoing, a need exists for subterranean fracture location detection methods which alleviate at least some of the above-mentioned problems, limitations and disadvantages associated with previously utilized fracture location detection and frac-pack and gravel-pack evaluation techniques as generally described above.

BRIEF DESCRIPTION OF THE DRAWINGS

FIG. 11 shows a modeled uncased wellbore geometry (shown in a horizontal well) for an open-hole fracturing, frac-packing, or gravel packing operation where Gd tagged proppant/sand is placed in the fractured region in the formation and/or in the annular space between the borehole wall and an interior tubing/screen/liner.

DETAILED DESCRIPTION

Figure 1:
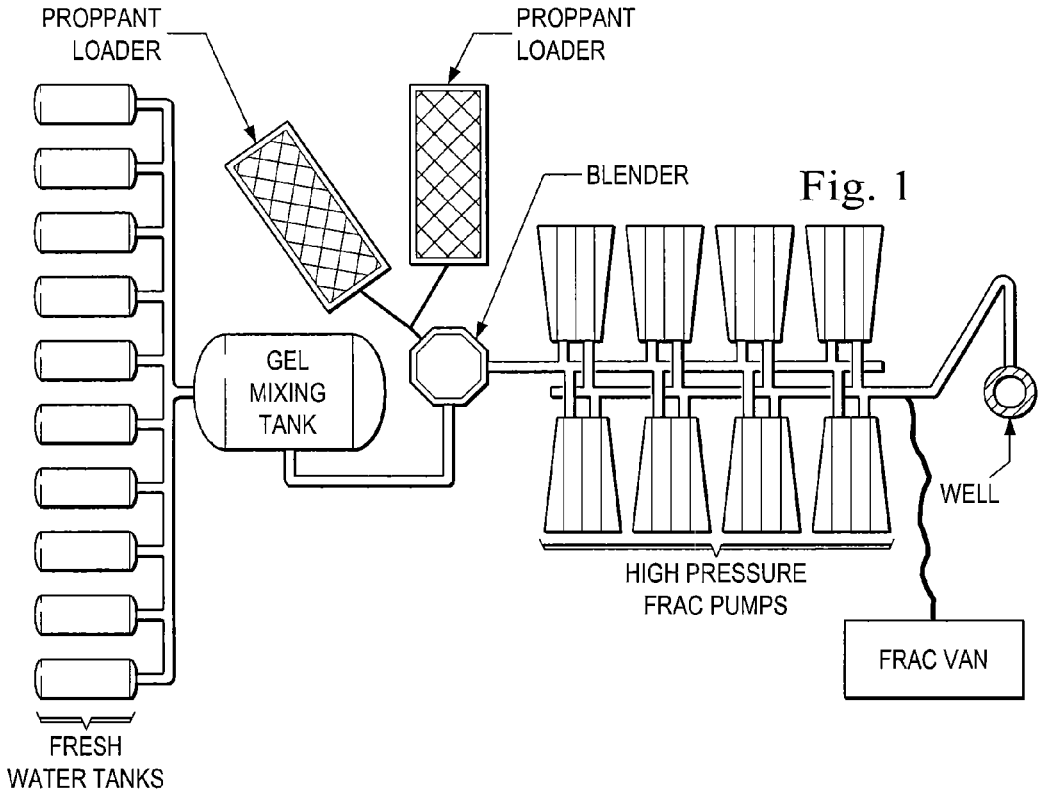
FIG. 1 is a schematic diagram of a wellsite frac layout.

The methods described herein do not use complex and/or high resolution gamma ray spectroscopy detectors. In addition, spectral data analysis methods are not required, and the depth of investigation is deeper than nuclear techniques employing downhole neutron activation. There is no possible hazard resulting from flowback to the surface of radioactive proppants or fluids, nor the contamination of equipment at the wellsite. The logistics of the operation are also very simple: (1) the proppant can be prepared well in advance of the required frac operations without worrying about radioactive decay associated with delays, (2) there are no concerns related to radiation exposure to the proppant during proppant transport and storage, (3) any excess proppant prepared for one frac job could be used on any subsequent frac job, and (4) the logging tools required are widely available and generally inexpensive to run. Also, slow logging speed is not an issue and there is no need for sophisticated gamma ray spectral deconvolution or other complex data processing (other than possible log normalization).

Moreover, the cost of the procedure when using PNC tools is lower than methods requiring expensive tracer materials, sophisticated detection equipment, high cost logging tools, or sophisticated data processing.

Embodiments of the present invention include a method for determining the location and height of a fracture in a subterranean formation region, and/or the pack material in the vicinity of the borehole, in frac-pack and gravel-pack operations using a PNC logging tool. The method includes obtaining a pre-fracture data set, hydraulically fracturing and packing the formation fractures, and/or packing portions of the borehole region, with a slurry that includes a liquid and a proppant (defined to also include sand or other conventional pack material) in which all or a fraction of such proppant includes a thermal neutron absorbing material, obtaining a post-fracture data set, and comparing the pre-fracture data set and the post-fracture data set. This comparison indicates the location and radial distribution of the proppant in the fracture relative to the proppant placed in the borehole region. This proppant location/distribution is then correlated to depth measurements of the borehole. In this way, the location and height of the fracture is determined from tagged material indicated to be in the fracture, and a simultaneous estimate can be made of the proppant which has been placed in the pack zone in the annular space either outside the outer wellbore tubular or between two wellbore tubulars.

The pre-fracture and post-fracture data sets are each obtained by lowering into a borehole traversing a subterranean formation, a neutron emitting tool including a pulsed fast neutron source and one or more thermal neutron or gamma ray detectors, emitting neutrons from the neutron source into the borehole and formation, and detecting in the borehole region thermal neutrons or capture gamma rays resulting from nuclear reactions of the source neutrons with elements in the borehole region and subterranean formation. For purposes of this application, the term "borehole region" includes the logging tool, the borehole fluid, the tubulars in the wellbore and any other annular material such as cement that is located between the formation and the tubular(s) in the wellbore.

According to certain embodiments using a PNC tool, the pre-fracture and post-fracture data sets are used to distinguish proppant in the formation from proppant in the wellbore.

According to certain embodiments of the present invention which utilizes a PNC tool, the PNC logging tool generates data that includes log count rates, computed formation thermal neutron capture cross-sections, computed borehole thermal neutron capture cross-sections, and computed formation and borehole decay component count rate related parameters and/or gated count rates in selected time intervals following the neutron bursts.

According to certain embodiments of the present invention, the pre-fracture and post-fracture data sets are normalized prior to the step of comparing the pre-fracture and post-fracture data sets. Normalization involves adjusting the pre-fracture and post-fracture data for environmental and/or tool differences in order to compare the data sets.

According to certain embodiments of the present invention, the frac slurry (or "frac-pack slurry" or "gravel-pack slurry" depending on the fracing or packing operation being performed) includes a proppant containing the thermal neutron absorbing material. The proppant is illustratively a granular material which, when respectively used in a fracing, frac-packing or gravel-packing operation, may be referred to herein as comprising (1) "fracing particles" positionable in a subterranean formation outside of a well bore, (2) "frac-pack particles" positionable in a "frac-pack zone" within a wellbore in conjunction with a frac-packing operation, or (3) "gravel-pack particles" positionable within a "gravel-pack zone" within a wellbore in conjunction with a gravel packing operation. The proppant doped with the thermal neutron absorbing material has a thermal neutron capture cross-section exceeding that of elements normally encountered in subterranean zones to be fractured. According to certain embodiments of the present invention, the proppant containing the thermal neutron absorbing material has a macroscopic thermal neutron capture cross-section of at least about 90 capture units, and preferably up to 900 capture units or more. Preferably, the proppant material is a granular ceramic material, with substantially every grain of the proppant material having a high capture cross section thermal neutron absorbing material integrally incorporated therein.

According to yet another embodiment of the present invention, the thermal neutron absorbing material is boron, cadmium, gadolinium, iridium, samarium, or mixtures thereof.

Suitable boron containing high capture cross-section materials include boron carbide, boron nitride, boric acid, high boron concentrate glass, zinc borate, borax, and combinations thereof. A proppant containing 0.1% by weight of boron carbide has a macroscopic capture cross-section of approximately 92 capture units. A suitable proppant containing 0.025-0.030% by weight of gadolinium oxide has similar thermal neutron absorption properties as a proppant containing 0.1% by weight of boron carbide. Some of the examples set forth below use boron carbide; however those of ordinary skill in the art will recognize that any high capture cross section thermal neutron absorbing material, such as gadolinium oxide, can be used.

According to certain embodiments of the present invention, the proppant utilized includes about 0.025% to about 4.0% by weight of the thermal neutron absorbing material. According to certain embodiments of the present invention, the proppant includes a concentration of about 0.1% to about 4.0% by weight of a boron compound thermal neutron absorbing material. According to certain embodiments of the present invention, the proppant includes a concentration of about 0.025% to about 1.0% by weight of a gadolinium compound thermal neutron absorbing material.

According to embodiments of the present invention, the proppant may be a ceramic proppant, sand, resin coated sand, plastic beads, glass beads, and other ceramic or resin coated proppants. Such proppants may be manufactured according to any suitable process including, but not limited to continuous spray atomization, spray fluidization, spray drying, or compression. Suitable proppants and methods for manufacture are disclosed in U.S. Pat. Nos. 4,068,718, 4,427,068, 4,440,866, 5,188,175, and 7,036,591, the entire disclosures of which are incorporated herein by reference.

According to certain embodiments of the present invention, the thermal neutron absorbing material is added to the ceramic proppant during the manufacturing process such as continuous spray atomization, spray fluidization, spray drying, or compression. Ceramic proppants vary in properties such as apparent specific gravity by virtue of the starting raw material and the manufacturing process. The term "apparent specific gravity" as used herein is the weight per unit volume (grams per cubic centimeter) of the particles, including the internal porosity. Low density proppants generally have an apparent specific gravity of less than 3.0 g/cc and are typically made from kaolin clay and alumina. Intermediate density proppants generally have an apparent specific gravity of about 3.1 to 3.4 g/cc and are typically made from bauxitic clay. High strength proppants are generally made from bauxitic clays with alumina and have an apparent specific gravity above 3.4 g/cc. A thermal neutron absorbing material may be added in the manufacturing process of any one of these proppants to result in proppant suitable for use according to certain embodiments of the present invention. Ceramic proppant may be manufactured in a manner that creates porosity in the proppant grain. A process to manufacture a suitable porous ceramic is described in U.S. Pat. No. 7,036,591, the entire disclosure of which is incorporated by reference herein. In this case the thermal neutron absorbing material is impregnated into the pores of the proppant grains to a concentration of about 0.025 to about 4.0% by weight.

According to certain embodiments of the present invention, the thermal neutron absorbing material is incorporated into a resin material and ceramic proppant or natural sands are coated with the resin material containing the thermal neutron absorbing material. Processes for resin coating proppants and natural sands are well known to those of ordinary skill in the art. For example, a suitable solvent coating process is described in U.S. Pat. No. 3,929,191, to Graham et al., the entire disclosure of which is incorporated herein by reference. Another suitable process such as that described in U.S. Pat. No. 3,492,147 to Young et al., the entire disclosure of which is incorporated herein by reference, involves the coating of a particulate substrate with a liquid, uncatalyzed resin composition characterized by its ability to extract a catalyst or curing agent from a non-aqueous solution. Also a suitable hot melt coating procedure for utilizing phenol-formaldehyde novolac resins is described in U.S. Pat. No. 4,585,064, to Graham et al, the entire disclosure of which is incorporated herein by reference. Those of ordinary skill in the art will be familiar with still other suitable methods for resin coating proppants and natural sands.

Accordingly, the methods of the present invention may be implemented with ceramic proppant or natural sands coated with or otherwise containing the thermal neutron absorbing material. According to certain embodiments of the present invention, a suitable thermal neutron absorbing material is either boron carbide or gadolinium oxide, each of which has an effective thermal neutron absorbing capacity at a low concentration in tagged proppant or sand. The concentration of such thermal neutron absorbing materials is generally on the order of about 0.025% to about 4.0% by weight of the proppant. For boron compounds such as boron carbide, the concentration is about 0.1% to about 4.0% by weight of the proppant, and for gadolinium compounds such as gadolinium oxide, the concentration is about 0.025% to about 1.0% by weight of the proppant. These concentrations are low enough such that the other properties of the tagged proppant (such as crush strength) are essentially unaffected by the addition of the high capture cross section material. While any high capture cross-section thermal neutron absorbing material may be used in the embodiments of the present invention, in some embodiments of the present invention which employ PNC tools, boron carbide or other boron containing materials may be used because thermal neutron capture by boron does not result in measurable gamma radiation in the detectors in the logging tool. Also, in embodiments of the present invention which employ PNC tools, gadolinium oxide or other gadolinium containing materials may be used because a smaller amount of the gadolinium-containing tagging material is required relative to boron containing materials. The weight percentage required to produce similar thermal neutron absorption properties for other high thermal neutron capture cross section materials will be a function of the density and molecular weight of the material used, and on the capture cross sections of the constituents of the material.

A manufactured ceramic proppant containing about 0.025% to about 4.0% by weight of a thermal neutron absorbing material can be cost effectively produced, and can provide useful fracture, frac-pack, or gravel-pack identifying signals when comparing PNC log responses run before and after a frac job. These signals are capable of indicating and distinguishing between the intervals that have and those that have not been fractured, propped, and/or packed.

As shown in FIG. 1, a wellsite fracturing operation involves blending water with a gel to create a viscous fracturing fluid. The proppant including a thermal neutron absorbing material is added to the viscous fracturing or packing fluid creating a slurry, which is pumped down the well, often with high pressure pumps. The slurry is forced into the fractures induced in the formation, and where appropriate, depending on the application, into the intervals desired to be packed in the borehole region in the vicinity of the fractures. The proppant particles are pumped downhole in a liquid (frac slurry) and into the induced fractures and the desired annular space(s) in the borehole region.

Figure 2:
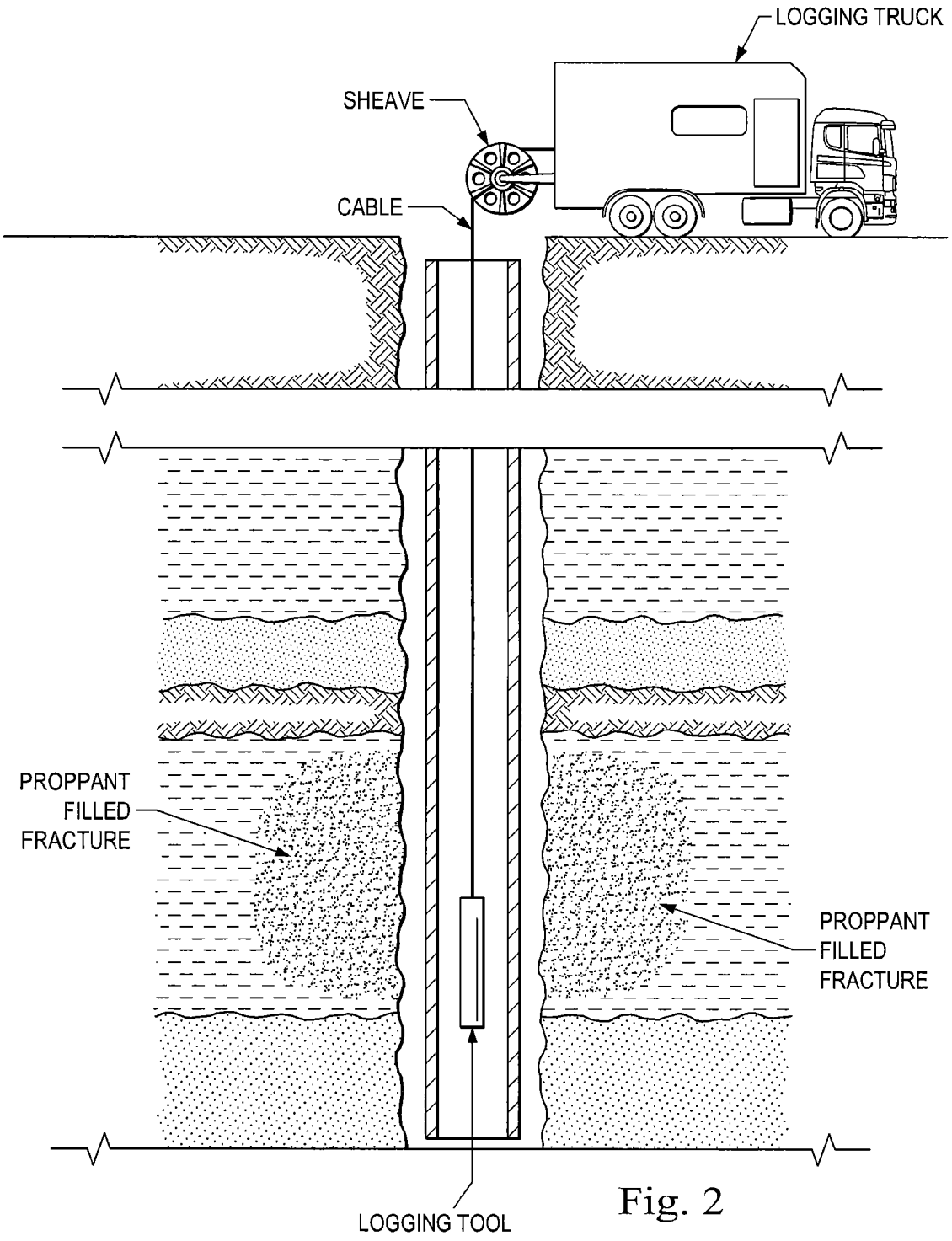
FIG. 2 is a schematic view showing logging of a downhole formation containing induced fractures.

FIG. 2 depicts a logging truck at the well site with a PNC logging tool at the depth of the induced fracture and/or packed interval. Power from the logging truck (or skid) is transmitted to the logging tool, which records and transmits logging data as the tool is logged past the fracture zone(s) and the formations above and/or below the zone(s) being fractured.

According to embodiments of the present invention, the induced hydraulic fracture and packed interval identification process using a proppant having a thermal neutron absorbing material and measurements from a PNC logging tool includes:

1. Preparing proppant doped with a thermal neutron absorbing material by fabricating the proppant from starting materials that include a thermal neutron absorbing material, by coating the thermal neutron absorbing material onto the proppant or by impregnating or otherwise incorporating the thermal neutron absorbing material into the proppant.

2. Running and recording, or otherwise obtaining, a pre-frac (defined to include pre gravel-pack) PNC log across the potential zones to be fractured to obtain a pre-frac data set, and preferably also including zones outside the potential fracture zones.

3. Conducting a hydraulic fracturing, frac-packing, or gravel-packing operation in the well, incorporating the proppant having a thermal neutron absorbing material into the slurry pumped downhole.

4. Running and recording a post-frac (defined to include post gravel-pack) PNC log, if possible utilizing the same tool type as used in the pre-frac log, across the potential zones of interest, including one or more fracture, frac-pack or gravel-pack intervals to obtain a post-frac data set, and preferably also including zones outside the interval where fracturing, frac-packing, and/or gravel-packing was anticipated. The logs may be run with the tool centered or eccentered within the casing or tubing. The pre-frac and post-frac logs are preferably run in the same condition of eccentricity.

5. Comparing the pre-frac and post-frac data sets from the pre-frac and post-frac logs (after any log normalization), to determine location (both vertical and radial) of proppant. Normalization may be necessary if the pre-frac and post-frac logs were run with different borehole conditions, or if different tools or sources were used. This may be especially true if the pre-frac log was recorded at an earlier time in the life history of the well, using wireline, memory, and/or logging-while-drilling (LWD) sensors. Normalization procedures compare the log data from zones preferably outside of the possibly fractured and/or packed intervals in the pre-frac and post-frac logs. Since these zones have not changed between the logs, the gains and/or offsets are applied to the logs to bring about agreement between the pre-fracture and post-fracture logs in these normalization intervals. The same gains/offsets are then applied to the logs over the entire logged interval. Differences in the data indicate the presence of proppant in the fracture and/or the borehole region in the vicinity of the fracture, and also indicate the presence of the proppant in the fracture relative to the proppant in the packed annular region of the borehole.

For PNC tools, increases in computed formation and/or borehole capture cross-sections, and decreases in the computed borehole and/or formation component count rates in selected time intervals between the neutron bursts in the post-frac log relative to the pre-frac log indicate the presence of proppant containing a thermal neutron absorbing material. Comparisons between the various PNC measurement parameters having different formation vs. borehole sensitivities, can be used to indicate the relative radial position of the tagged proppant (i.e., the relative distribution of the proppant in the annular packed zone in the borehole vs. the proppant out in fractures in the formation.

6. Detecting the location and height of the propped fracture and the location of proppant packed in the borehole region by correlating the differences in data from step (5) to a depth measurement of the borehole.

Further embodiments of the present invention include changes in the methods described herein such as, but not limited to, incorporating multiple pre-frac logs into any pre-frac versus post-frac comparisons, or the use of a simulated log for the pre-frac log (such simulated logs being obtained for instance using neural networks to generate simulated PNC log responses from other open or cased hole logs on the well), or the use of multiple stationary logging measurements instead of, or in addition to, data collected with continuous logs.

In additional embodiments of the invention, first and second post-frac (defined to also include post-gravel pack) data sets are obtained and utilized to determine the differences, if any, between the quantities of proppant in the fractured and/or packed zones before producing a quantity of well fluids from the subterranean formation and the quantities of proppant in the corresponding zones after such production by comparing the post-frac (defined to also include post gravel pack) data sets. The determined proppant quantity differences are utilized to determine one or more production and/or fracture-related characteristics of the subterranean formation such as: (a) one or more of the fracture zones and/or packed zones is not as well filled with proppant material as it was initially, (b) production from one or more of the producing zones is greater than the production from the other zones, and (c) one or more of the intended producing zones is not producing. This post-frac (or post gravel pack) procedure may be carried out using a pulsed neutron capture logging tool, possibly augmented with other wellsite information or information provided by other conventional logging tools, such as production logging tools.

According to certain embodiments of the thermal neutron logging method, fast neutrons are emitted from a neutron source into the wellbore and formation, and are rapidly thermalized to thermal neutrons by elastic and inelastic collisions with formation and borehole region nuclei. Elastic collisions with hydrogen in the formation and the borehole region are a principal thermalization mechanism. The thermal neutrons diffuse in the borehole region and the formation, and are eventually absorbed by one of the nuclei present. Generally these absorption reactions result in the almost simultaneous emission of capture gamma rays; however, absorption by boron is a notable exception. The detectors in the PNC logging tool either directly detect the thermal neutrons that are scattered back into the tool, or indirectly by detecting the gamma rays resulting from the thermal neutron absorption reactions (used in most commercial versions of PNC tools). Most PNC tools are configured with a neutron source and two detectors arranged above the neutron source which are referred to herein as a "near" detector and a "far" detector. According to embodiments of the present invention, pulsed neutron capture tools may be used that include one detector, or more than two detectors. For example, a suitable PNC tool could incorporate a pulsed neutron source and three detectors arranged above the neutron source, which are referred to herein as the near, far, and "extra-far" or "xfar" detectors such that the near detector is closest to the neutron source and the xfar detector is the farthest away from the neutron source. It is also possible that one or more of the neutron or capture gamma ray detectors may be located below the neutron source.

A pulsed neutron capture tool logging system measures the decay rate (as a function of time between the neutron pulses) of the thermal neutron or capture gamma ray population in the formation and the borehole region. From this decay rate curve, the capture cross-sections of the formation $\Sigma_{fm}$ (sigma-fm) and borehole $\Sigma_{bh}$ (sigma-bh), and the formation and borehole decay components can be resolved and determined. The higher the total capture cross-sections of the materials in the formation and/or in the borehole region, the greater the tendency for that material to capture thermal neutrons. Therefore, in a formation having a high total capture cross-section, the thermal neutrons disappear more rapidly than in a formation having a low capture cross-section. This appears as a steeper slope in a plot of the observed count rate versus time after the neutron burst.

The differences between the PNC borehole and formation pre-frac and post-frac parameters can be used to distinguish proppant in the formation from proppant in the wellbore.

Figure 4A:
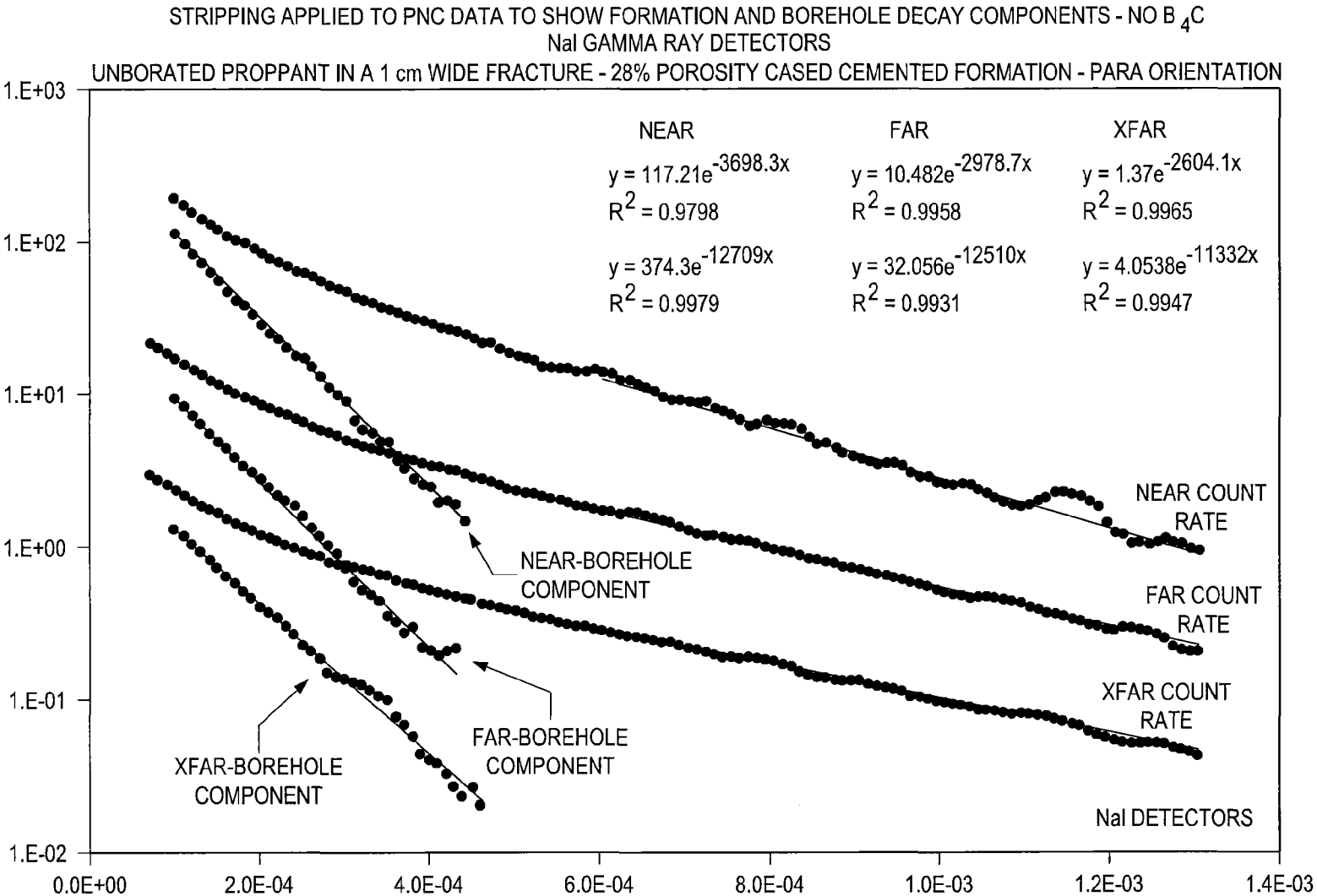
FIGS. 4A-4B show modeled PNC decay curves in a conventional frac operation before (FIG. 4A) and after (FIG. 4B) frac slurry with a 1% boron tag is placed in a bi-wing fracture (as in FIG. 3A).
Figure 4B:
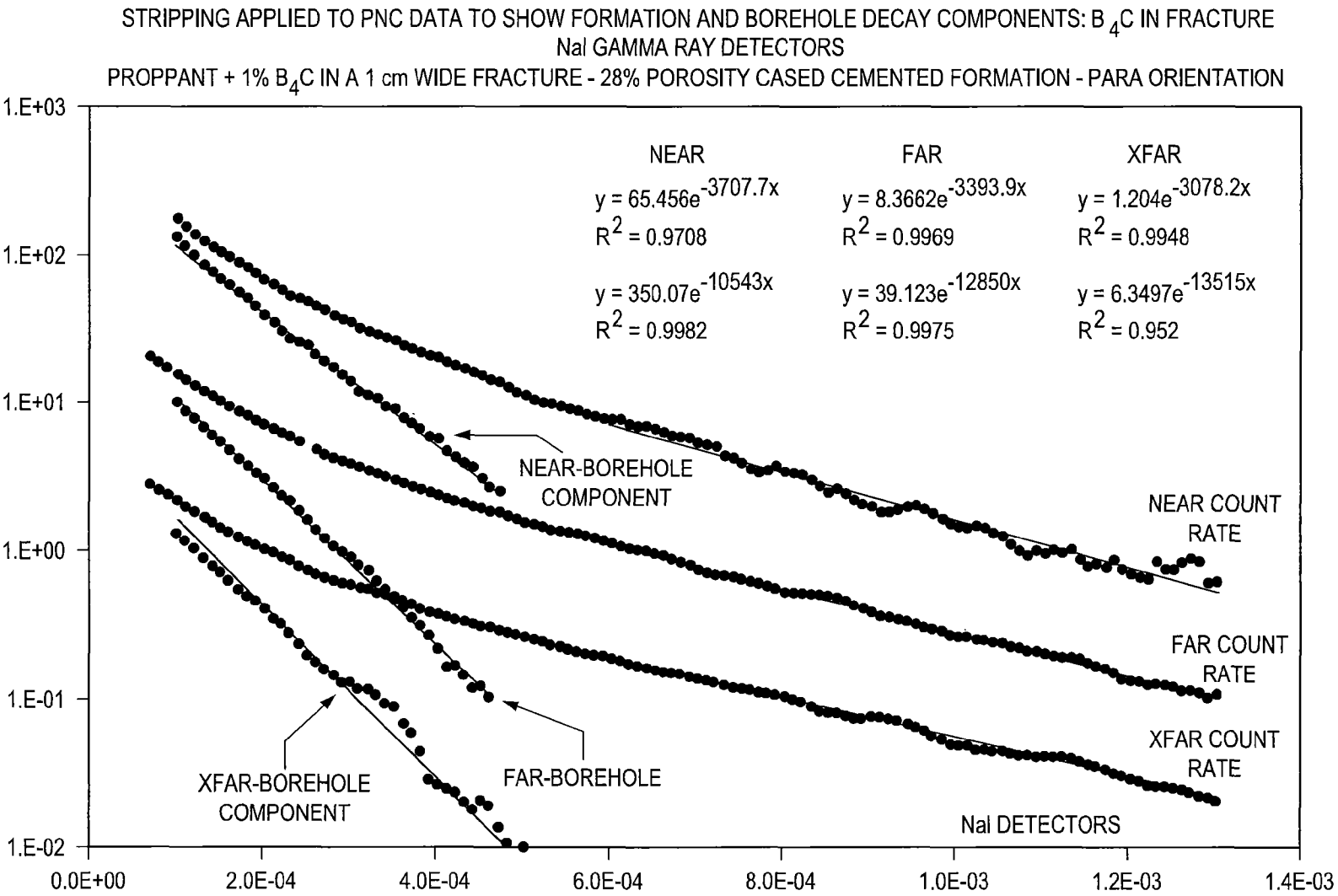

The PNC data used to generate FIGS. 4A and 4B was modeled using tools employing gamma ray detectors. A capture gamma ray detector measures gamma rays emitted after thermal neutrons are captured by elements in the vicinity of the thermal neutron "cloud" in the wellbore and formation. If proppant doped with boron or gadolinium is present, the count rate decreases observed in PNC tools employing gamma ray detectors may be accentuated relative to tools with thermal neutron detectors.

The following examples are presented to further illustrate various aspects of the present invention, and are not intended to limit the scope of the invention. The examples set forth below were generated using the Monte Carlo N-Particle Transport Code version 5 (hereinafter "MCNP"). The MCNP is a software package that was developed by Los Alamos National Laboratory and is commercially available within the United States from the Radiation Safety Information Computation Center (http://www-rsicc.ornl.gov). The MCNP software can handle geometrical details and accommodates variations in the chemical composition and size of all modeled components, including borehole fluid salinity, the concentration of the thermal neutron absorbing material in the proppant in the fracture, and the width of the fracture. The MCNP data set forth below generally resulted in statistical standard deviations of approximately 0.5-1.0% in the computed count rates.

In some of the following illustrations, the proppant was doped with either boron carbide or gadolinium oxide; however other suitable thermal neutron absorbing materials may be used. In some applications, the desired proppant is a granular ceramic material into substantially every grain of which the dopant is integrally incorporated. In other applications, not all proppant grains have to be tagged, and in some applications, sand or other hard granular materials may be utilized, with the tag material applied as a coating.

Figure 3A:
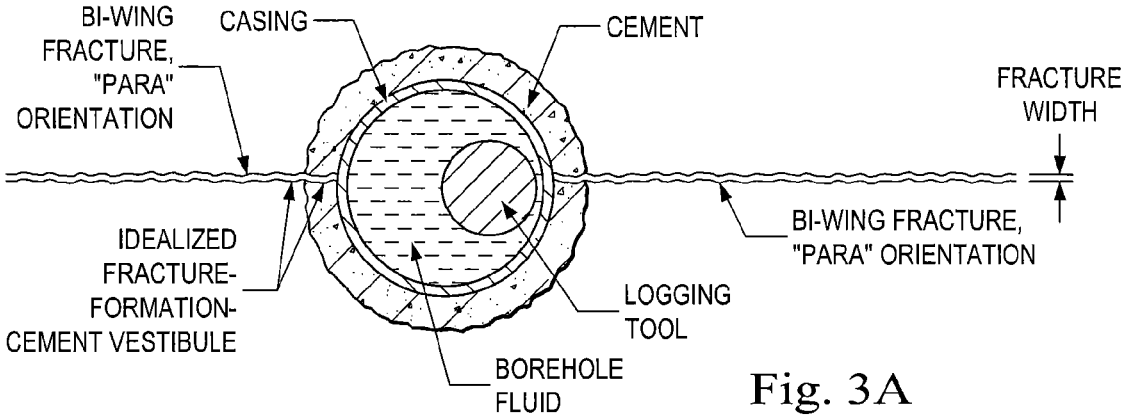
FIGS. 3A and 3B are plan views from the orientation of the Z-axis with respect to "para" and "perp" tool placement geometries relative to the fracture.
Figure 3B:
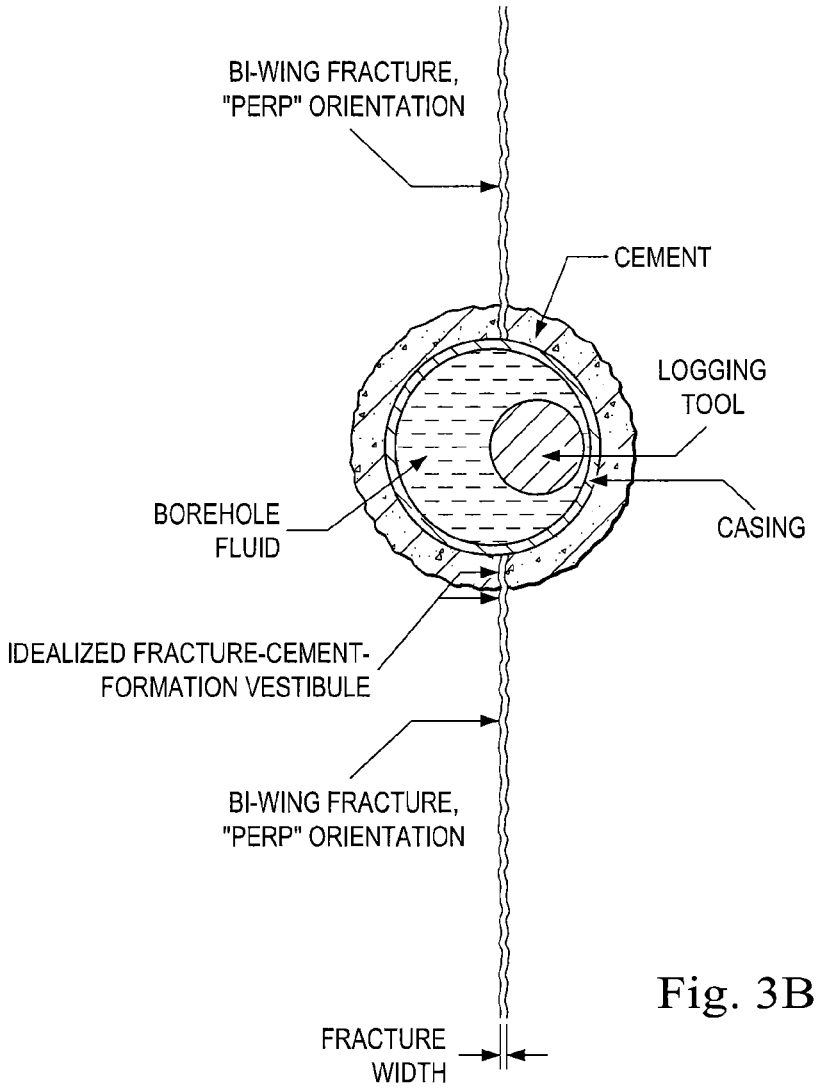

For the purposes of most of the following examples, FIGS. 3A and 3B present views along the Z-axis of the geometries used in the MCNP modeling. In these cases the 8 inch diameter borehole is cased with a 5.5 inch O.D. 24 lb/ft. steel casing and no tubing, and is surrounded by a 1 inch wide cement annulus. The 1.6875 inch diameter PNC tool is shown in the parallel ("para") position in FIG. 3A and in the perpendicular ("perp") position in FIG. 3B. In the "para" position the decentralized logging tool is aligned with the fracture, and in the "perp" position it is positioned 90° around the borehole from the fracture.

In FIGS. 3A and 3B, the formation area outside the cement annulus was modeled as a sandstone with a matrix capture cross-section of approximately 10 capture units (cu). These two figures show the idealized modeling of the formation and borehole region that was used in many MCNP runs. The bi-wing vertical fracture extends radially away from the wellbore casing, and the frac slurry in the fracture channel replaces the cement in the channel as well as the formation in the channel outside the cement annulus. The width of the fracture channel was varied between 0.1 cm and 1.0 cm in the various modeling runs. The MCNP model does not provide output data in the form of continuous logs, but rather data that permit, in given formations and at fixed positions in the wellbore, comparisons of pre-frac and post-frac logging responses.

PNC Example

A PNC system having a 14-MeV pulsed neutron generator was modeled using MCNP to determine the height of a fracture in a formation from detecting tagged proppant material deposited the formation fractures and/or to detect the placement of proppant/pack material into the desired annular borehole region in frac-pack and gravel-pack applications. Decay curve count rate data detected in thermal neutron or gamma ray sensors are recorded after the fracturing/packing operation. As in the case of neutron and compensated neutron tools in previously referenced U.S. Pat. No. 8,100,177, the observed parameters are then compared to corresponding values recorded in a logging run made before the well was fractured/packed, again preferably made with the same or a similar logging tool and with the same borehole conditions as the post-frac log. The formation and borehole thermal neutron absorption cross-sections are calculated from the observed two-component decay curves. Increases in the formation and/or borehole thermal neutron absorption cross-sections in the post-frac PNC logs relative to the pre-frac logs, as well as decreases between the logs in count rates selected time intervals between the neutron bursts, and also decreases in count rates in computed formation and/or borehole component count rate integrals are used to identify the presence of boron or gadolinium doped proppant in the induced fracture(s) and/or in the packed annular borehole region, generally in the vicinity of the fractured zone. Selections of, and/or comparisons of, the PNC measurement parameters with differing relative formation vs. borehole region sensitivities are made to obtain indications of the relative presence of tagged proppant in formation fractures vs. frac-packed or gravel-packed packed annular spaces within the borehole.

A PNC tool can be used for data collection and processing to enable observation of both count rate related changes and changes in computed formation and borehole thermal neutron capture cross-sections so as to identify the presence of the neutron absorber in the proppant.

In current "dual exponential" PNC tools, as disclosed in SPWLA Annual Symposium Transactions, 1983 paper CC entitled Experimental Basis For A New Borehole Corrected Pulsed Neutron Capture Logging System (Thermal Multigate Decay "TMD") by Shultz et al.; 1983 paper DD entitled Applications Of A New Borehole Corrected Pulsed Neutron Capture Logging System (TMD) by Smith, Jr. et al.; and 1984 paper KKK entitled Applications of TMD Pulsed Neutron Logs In Unusual Downhole Logging Environments by Buchanan et al., the equation for the detected count rate c(t), measured in the thermal neutron (or gamma ray) detectors as a function of time between the neutron bursts can be approximated by Equation 1:

$$c(t)=A_{bh}\exp(-t/\tau_{bh})+A_{fm}\exp(-t/\tau_{fm}), \quad (1)$$

where t is time after the neutron pulse, $A_{bh}$ and $A_{fm}$ are the initial magnitudes of the borehole and formation decay components at the end of the neutron pulses (sometimes called bursts), respectively, and $\tau_{bh}$ and $\tau_{fm}$ are the respective borehole and formation component exponential decay constants. The borehole and formation component capture cross-sections $\Sigma_{bh}$ and $\Sigma_{fm}$ are inversely related to their respective decay constants by the relations:

$$\tau_{fm}=4550/\Sigma_{fm},$$

and $$\tau_{bh}=4550/\Sigma_{bh}, \quad (2)$$

where the cross-sections are in capture units and the decay constants are in microseconds.

An increase in the capture cross-section $\Sigma_{fm}$ will be observed in the post-frac logs with proppant in the formation fractures relative to the pre-fracture pulsed neutron logs. Fortunately, due to the ability in PNC logging to separate the count rate signals from the borehole and formation, there will also be a reduced sensitivity in the formation capture cross-section to any unavoidable changes in the borehole region (such as borehole salinity or casing changes) between the pre-fracture and post-fracture pulsed neutron logs, relative to situations in which neutron or compensated neutron tools are used to make the measurements.

The formation decay component count rate (or the observed count rate in selected time-gated interval(s) between the neutron bursts) will also be affected (reduced) by the presence of neutron absorbers in the proppant in the fractures, especially in PNC tools having gamma ray detectors. These formation component or gated count rates will also be reduced with taggant present in the in the annular frac-pack or gravel-pack regions within the overall borehole region, since many of the thermal neutrons primarily decaying in the formation may actually be captured in the borehole region (this is the same reason a large number of iron gamma rays are seen in spectra from time intervals after the neutron bursts dominated by the formation decay component, although the only iron present is in the well tubular(s) and tool housing in the borehole region).

Since most modern PNC tools also measure the borehole component decay, an increase in the borehole capture cross-section $\Sigma_{bh}$ and a change in the borehole component count rate in the post-frac log relative to the pre-frac log generally will indicate the presence of proppant in the vicinity of the borehole, including frac-packed or gravel-packed regions.

FIGS. 4A-4B and Table 1 show MCNP modeled results for one PNC tool embodiment of the present invention in a conventional fracturing operation, where no packing of the proppant into a borehole frac-pack region was desired. NaI gamma ray detectors were used in all of the PNC models. The data was obtained using a hypothetical 1.6875 inch diameter PNC tool to collect the pre-frac data (FIG. 4A), in a conventional formation fracturing operation, and the post-frac data (FIG. 4B) data with proppant having 1.0% boron carbide in a 1.0 cm wide fracture in a 28.3% porosity formation. Unless otherwise noted, borehole and formation conditions are the same as described in FIG. 3A. The source-detector spacings are the same as those utilized in the previous neutron log examples. In FIGS. 4A-4B, the total count rates in each time bin along each of the decay curves are represented as points along the time axis (x axis). The near detector decay is the slowly decaying upper curve in each figure, the far detector decay is the center curve, and the x-far detector decay is the lower curve. The computed formation decay components from the two exponential fitting procedures are the more slowly decaying exponentials (the solid lines in the figures) plotted on the total decay curve points in each figure (for each detector). The divergence of the decay curve in the earlier portions of the curve from the solid line is due to the additional count rate from the more rapidly decaying borehole component. The points representing the more rapidly decaying borehole region decay shown in the figures were computed by subtracting the computed formation component from the total count rate. Superimposed on each of the points along the borehole decay curves are the lines representing the computed borehole exponential equations from the two exponential fitting algorithms. The $R^2$ values associated with each computed exponential component in FIGS. 4A and 4B reveal how closely the computed values correlate to the actual data, with 1.0 indicating a perfect fit. The computed formation and borehole component cross-sections for the far detector are also shown in FIGS. 4A and 4B. The good fits between the points along all the decay curves and the computed formation and borehole exponential components confirm the validity of the two exponential approximations.

Table 1 displays the computed formation and borehole information from FIGS. 4A and 4B, and also similar information from decay curves computed with the fractures in the perp orientation relative to the tool (see FIG. 3B). As seen in Table 1, although the formation component capture cross-sections, $\Sigma_{fm}$, are not observed to change as much as would be computed from purely volumetric considerations, there are nevertheless appreciable (up to 18%) increases observed in $\Sigma_{fm}$ with the boron carbide doped proppant in the fracture, depending on detector spacing. Also from Table 1, it can be seen that the orientation of the tool in the borehole relative to the fracture (para vs. perp data) is not as significant as would have been observed for the compensated neutron tools. When 0.27% $Gd_2O_3$ (as opposed to 1.0% $B_4C$) was modeled in the MCNP5 software as the high capture cross section material in the proppant, $\Sigma_{fm}$ increased in a similar manner as discussed above with respect to boron carbide. Also, from Equation 1, the integral over all time of the exponentially decaying count rate from the formation component as can be computed as $A_{fm}*\tau_{fm}$, where $A_{fm}$ is the initial magnitude of the formation decay component and $\tau_{fm}$ is the formation component exponential decay constant. The computed formation component $A_{fm}*\tau_{fm}$ count rate integral decreases about 22-44% with the boron carbide doped proppant in the fracture, which is a significant fracture signal. The observed count rate decay curves summed over a given selected time interval after the neutron bursts, preferably in which the formation component count rate dominates (for example 400-1000 μsec), could be substituted for, or computed in addition to, $A_{fm}*\tau_{fm}$. Some changes are also observed in Table 1 for the borehole component cross-sections and count rates. These changes, although also potentially useful for frac identification, do not appear to be as systematic as the changes in the formation component data, since proppant placed only in formation fractures primarily affects PNC formation, as opposed to borehole, parameters.

TABLE 1

Computed formation and borehole count rate parameters and formation and borehole capture cross-sections from the data illustrated in FIGS. 4A-4B. Also shown are similar PNC data for perp orientation of tool relative to the fracture. Plain cement is present in the borehole annulus. NaI gamma ray detectors modeled.

| Detector | $B_4C$ in proppant | $\Sigma_{fm}$ capture units | $\tau_{fm}$ microsec. | Formation component intercept | Formation $A_{fm}*\tau_{fm}$ (×1/1000) | $\Sigma_{bh}$ capture units | $\tau_{bh}$ microsec. | Borehole component intercept | Borehole $A_{bh}*\tau_{bh}$ (×1/1000) |
|---|---|---|---|---|---|---|---|---|---|
| Near | 0% | 16.81 | 270.6722 | 117.21 | 31.725491 | 57.82 | 78.69249 | 374.3 | 29.4546 |
| para | 1% | 16.85 | 270.0297 | 65.46 | 17.676142 | 47.97 | 94.85095 | 350.07 | 33.20447 |
| (1%-0%)/0% | | 0.0% | | | −44% | −17% | | | 13% |
| Far | 0% | 13.54 | 336.0414 | 10.48 | 3.5217134 | 56.92 | 79.93675 | 32.06 | 2.562772 |
| para | 1% | 15.43 | 294.8801 | 8.37 | 2.4681465 | 58.46 | 77.831 | 39.12 | 3.044749 |
| (1%-0%)/0% | | 14% | | | −30% | 3% | | | 19% |
| Xfar | 0% | 11.84 | 384.2905 | 1.37 | 0.526478 | 51.56 | 88.2467 | 4.05 | 0.357399 |
| para | 1% | 13.99 | 325.2323 | 1.2 | 0.3902788 | 61.49 | 73.99577 | 6.35 | 0.469873 |
| (1%-0%)/0% | | 18% | | | −26% | 19% | | | 31% |
| Near | 0% | 17.55 | 259.2593 | 137.21 | 35.572963 | 58.83 | 77.34149 | 299.3 | 23.14831 |
| perp | 1% | 18.84 | 241.5074 | 103.69 | 25.041906 | 57.87 | 78.6245 | 407.2 | 32.0159 |
| (1%-0%)/0% | | 7% | | | −30% | −1.6% | | | 38% |
| Far | 0% | 13.11 | 347.0633 | 9.57 | 3.3213959 | 51.69 | 88.02476 | 30.56 | 2.690037 |
| perp | 1% | 14.69 | 309.7345 | 8.08 | 2.5026549 | 51.64 | 88.10999 | 31.65 | 2.788681 |
| (1%-0%)/0% | | 12% | | | −25% | 0.0% | | | 4% |
| Xfar | 0% | 11.79 | 385.9203 | 1.33 | 0.513274 | 43.98 | 103.4561 | 3.08 | 0.318645 |
| perp | 1% | 13.64 | 333.5777 | 1.2 | 0.4002933 | 49.95 | 91.09109 | 3.74 | 0.340681 |
| (1%-0%)/0% | | 16% | | | −22% | 14% | | | 7% |

The effects described in Table 1 can also be seen by visual observation of the decay curves in FIGS. 4A-4B. In comparing the three pre-fracture decay curves in FIG. 4A with the corresponding post-fracture curves in FIG. 4B, the formation components can be seen to decay more rapidly with the boron carbide doped proppant in the formation fractures (FIG. 4B). On the other hand, the decay rates of the borehole components are much less sensitive to the presence of the proppant in the fracture (FIG. 4B), but are very useful in identifying proppant in the cement region or in a frac-pack or gravel-pack annulus.

This reduced borehole component sensitivity to the proppant in the fracture can also be seen in the data in Table 1, which shows $\Sigma_{bh}$ and $A_{bh}*\tau_{bh}$, computed from the decay data in FIGS. 4A and 4B for the pre-fracture and post-fracture decay curves. There are much smaller percentage changes in the borehole parameters $\Sigma_{bh}$ and $A_{bh}*\tau_{bh}$ between pre-frac and post-frac decay data in conventional frac operations as compared to the percent change of the formation parameters such as $\Sigma_{fm}$, gated count rates, and $A_{fm}*\tau_{fm}$. This reduced borehole component sensitivity to the fracture is primarily due to the fact that the borehole region is not significantly different in these two situations (the fracture containing the proppant does not extend through the borehole region), and the borehole component is primarily sensing this region.

PNC formation parameters, as described earlier, are less sensitive than neutron or compensated neutron parameters to changes in non-proppant related changes in borehole conditions between the pre-frac and post-frac logs (such as borehole fluid salinity changes or changes in casing conditions). This is due to the ability of PNC systems to separate formation and borehole components.

Modern multi-component PNC tools detect gamma rays, which can be used to compute the formation decay cross-section, $\Sigma_{fm}$, that is only minimally sensitive to most borehole region changes in conventional frac operations, as seen above. If a PNC tool measuring thermal neutrons instead of gamma rays is employed, $\Sigma_{fm}$ will also be sensitive to formation changes (tagged fractures) and relatively insensitive to borehole region changes. As is the case with PNC tools containing gamma ray detectors, $A_{fm}*\tau_{fm}$ will be sensitive to the presence of proppant in the borehole, in part since the thermal neutrons will be additionally attenuated traversing this high capture cross-section borehole annulus between the formation and the detectors in the logging tool. The borehole decay parameters ($\Sigma_{bh}$ and $A_{bh}*\tau_{bh}$), like those measured in a PNC tool containing gamma ray detectors, are less sensitive than $\Sigma_{fm}$ and $A_{fm}*\tau_{fm}$ to changes in the formation, but borehole parameters, and especially $\Sigma_{bh}$, are very sensitive to tagged proppant in the cement region or in frac-pack or gravel-pack regions. Hence in a PNC tool containing thermal neutron detectors, the changes in all four parameters ($\Sigma_{fm}$, $A_{fm}*\tau_{fm}$, $\Sigma_{bh}$ and $A_{bh}*\tau_{bh}$) will generally be affected in the same way by tagged proppant as PNC tools containing gamma ray detectors.

Changes in $\Sigma_{fm}$ may be monitored if a difficult to quantify change in borehole region conditions (such as changes in borehole fluid salinity or casing conditions) has occurred between the log runs. Since $\Sigma_{fm}$ is not very sensitive to changes in the borehole region, $\Sigma_{fm}$ may be monitored if it is desired to emphasize detection of tagged proppant in the formation as opposed to tagged proppant in the borehole region. On the other hand, if some of the neutron absorber doped proppant is located in the cement region adjacent to an induced fracture, an increase in the computed borehole thermal neutron capture cross-section $\Sigma_{bh}$ will be observed in the post-frac log relative to the pre-frac log (changes in the borehole decay component count rates and $A_{bh}*\tau_{bh}$ would be less significant). These borehole parameter changes would be much less pronounced if the proppant had been in fractures in the formation. Another embodiment of the present invention provides for monitoring changes in $\Sigma_{bh}$ and $A_{fm}*\tau_{fm}$, and in come cases, $A_{bh}*\tau_{bh}$, (and a lack of change in $\Sigma_{fm}$) to detect proppant located in the cement/borehole region.

There are several situations in induced fracturing and frac-pack applications when it may be desirable to know not only that tagged proppant is present in intervals of interest, but also to know the relative radial depth of proppant placement. In conventional frac operations, it is useful to know the relative proportion of proppant out in the fracture versus in the damaged zone in the immediate vicinity of the borehole, including the cement region outside the casing. In cased-hole frac-pack applications, it would be useful to be able to distinguish proppant in the annulus between the well casing and the screen/tubing from proppant placed outside the casing in the frac-packed zone and fracture. In uncased fracturing, frac-packing, and gravel packing applications in wells containing liners and screens, including those in horizontal wells, it would be useful to distinguish proppant in the near borehole region outside the liner/screen versus that placed out in the induced fractures. Proppant detection with a compensated neutron tool (CNT), although having a small depth of investigation signal difference between the near and far detector measurements, is generally not nearly as well suited to addressing this depth of measurement problem as pulsed neutron capture (PNC) tools. PNC measurements, due to the pulsed operation of the source and the count rate measurements made by the detectors in multiple time gates after each neutron burst, can resolve and measure: (1) borehole and formation capture cross-sections from gamma ray (or thermal neutron) die-away data following the neutron bursts, (2) count rates in selected time intervals relative to the neutron bursts, and (3) formation and borehole decay component magnitudes. These PNC measurements/parameters are well suited to resolving depth of proppant location issues. Three PNC based depth of proppant determination scenarios are described below relating to conventional frac, cased-hole frac-pack, and uncased liner/screen frac, frac-pack, and gravel pack applications.

Scenario 1—Conventional Frac Application:

The geometry in this scenario (see FIG. 5) involves a vertical (or deviated or possibly horizontal) well in which is placed a cemented casing that is perforated. One embodiment of this new invention involves qualitatively and quantitatively analyzing the quality of a conventional frac job near wellbore. As used herein, the term "conventional frac job (or procedure)" means a formation fracturing procedure without associated packing of proppant into a borehole frac-pack zone. The typical geometry can be shown in FIG. 5. The MCNP modeled decay curves and the associated computed parameters are presented in FIG. 6 and Tables 2 and 3, including: formation and borehole component sigma (sigma=thermal neutron capture cross-section) values, the associated A×Tau integrated component decay count rate values, and the counts measured in several selected time intervals/gates delayed after the end of the neutron burst until the borehole component has essentially decayed away. Data modeled in FIG. 6 and Tables 2 and 3 assume a 1.0 cm wide bi-wing fracture (as seen in FIG. 3A), in a 28% porosity sand formation with a 5.5" casing centered inside a cemented 8" borehole. The neutron absorbing tag material in the proppant was 0.4% $Gd_2O_3$. From the gated count rate data in Table 2, measured in time intervals when the formation component of the decay is dominant, it can be seen that when tagged proppant (or tagged frac-sand) is present only in the fracture in the formation (case 2), a significant decrease in gated count rate is observed. Correspondingly, when tagged proppant is present only in the fracture (case 2 in Table 3), the formation capture cross-section increases, the borehole cross-section is relatively unaffected, and the A-fm×Tau-fm component count rate decreases, all relative to the corresponding values of those parameters before the frac operation.

TABLE 2

Figure 5:
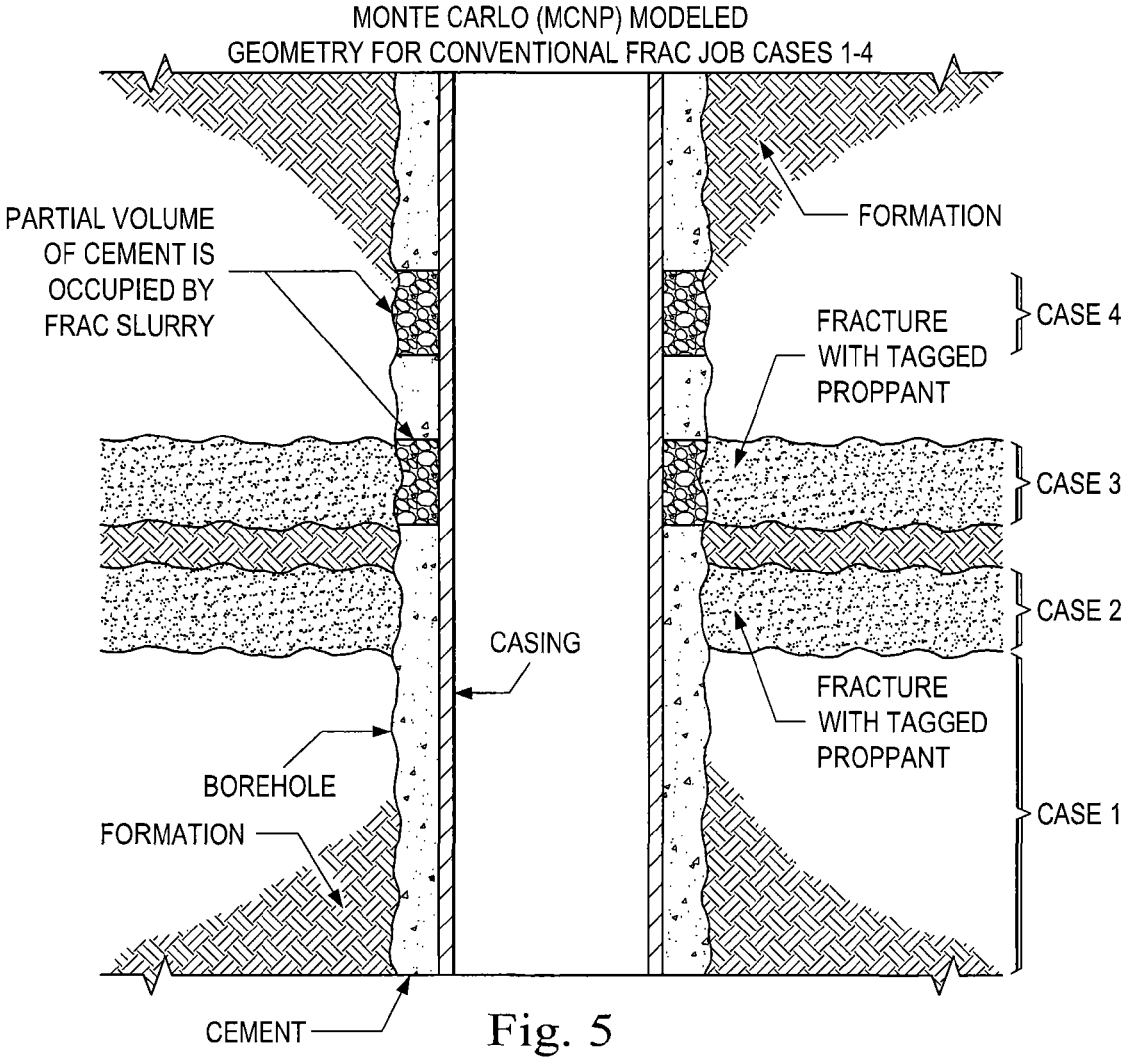
FIG. 5 shows modeled wellbore geometry for conventional fracturing operation wherein the proppant/sand material contains a high thermal neutron capture cross-section taggant, and the proppant/sand can be located in both the borehole region and also in induced formation fractures.
Figure 6:
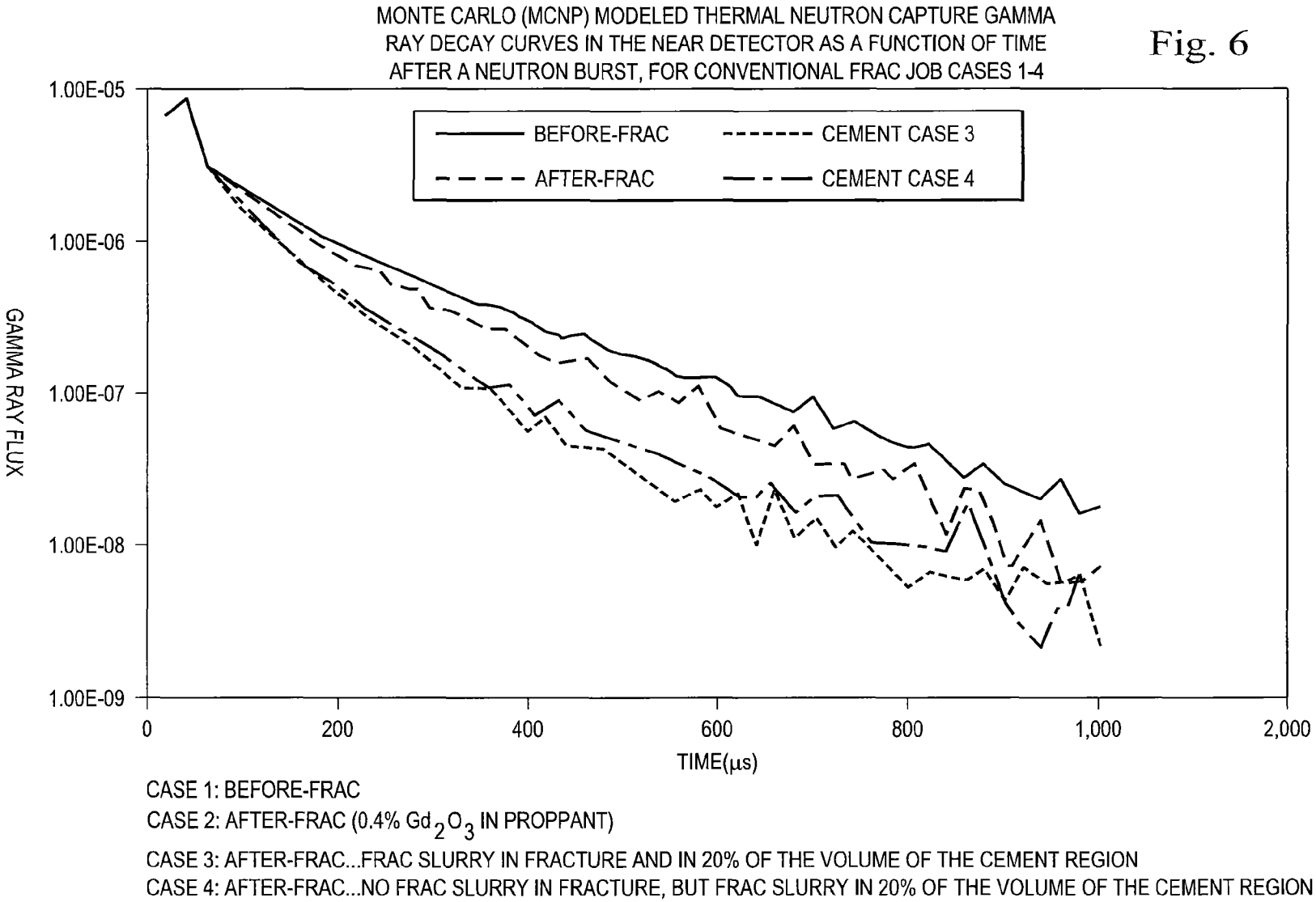
FIG. 6 shows modeled thermal neutron capture gamma ray decay curves in the near detector of a pulsed neutron capture (PNC) logging tool as a function of time after a neutron burst in a conventional fracturing operation in which $Gd_2O_3$ tag material has been added to the proppant/sand.

Decreases and % changes in PNC count rates in selected time gates for a conventional fracture geometry in cases 1-4, as described in FIGS. 5 and 6

| Time gate after | Case 1 | | Case 2 | | Case 3 | | Case 4 | |
|---|---|---|---|---|---|---|---|---|
| burst (mSec) | Near | Far | Near | Far | Near | Far | Near | Far |
| Capture Gamma Ray Counts in Time Gate | | | | | | | | |
| 400-1000 | 5.00E−06 | 9.51E−07 | 2.95E−06 | 5.39E−07 | 8.58E−07 | 2.28E−07 | 1.17E−06 | 2.58E−07 |
| 500-1000 | 2.91E−06 | 5.99E−07 | 1.60E−06 | 3.24E−07 | 4.50E−07 | 1.01E−07 | 6.45E−07 | 1.55E−07 |
| 600-1000 | 1.69E−06 | 3.79E−07 | 8.24E−07 | 1.92E−07 | 2.55E−07 | 5.96E−08 | 3.69E−07 | 9.77E−08 |
| Percentage Change in Counts Relative to Before Frac Case | | | | | | | | |
| 400-1000 | | | −41% | −43% | −83% | −95% | −75% | −95% |
| 500-1000 | | | −45% | −46% | −85% | −96% | −78% | −95% |
| 600-1000 | | | −51% | −50% | −85% | −97% | −78% | −94% |

TABLE 3

PNC Measurement parameters -conventional frac geometry in cases 1-4 in FIGS. 5 and 6 Near Detector Decay Curve Parameters

| | $A_{fm}$ | $Sig\neg_{fm}$(cu) | $A_{fm}*t_{for}$ | $A_{bh}$ | $Sig\neg_{bh}$(cu) | $A_{bh}*t_{bh}$ |
|---|---|---|---|---|---|---|
| Case 1 - before frac | 367.92 | 22.94 | 72965.74 | 1190.61 | 69.95 | 77441.89 |
| Case 2 - after frac | 353.82 | 27.25 | 59082.73 | 1084.65 | 70.33 | 70165.76 |
| Case 3 - after frac | 87.08 | 26.79 | 14787.13 | 1297.55 | 73.94 | 79849.36 |
| Case 4 - after-frac | 94.75 | 24.26 | 17769.97 | 1263.31 | 71.34 | 80568.69 |

When tagged proppant is also present in the borehole annulus (cement) region outside the casing as well as in the fracture, but not in the borehole fluid inside the casing (case 3), there is virtually no change in the formation sigma or borehole sigma values relative to the after frac log with tag material only in the fracture. (Note: the borehole component decay being measured is primarily influenced by the decay in the borehole fluid itself and not by the much more quickly decaying count rate in the tagged proppant in the annulus outside the casing . . . and hence the observed sigma-borehole does not change much in case 3 relative to case 2). On the other hand, the A-fm×Tau-fm value and the gate count rates in Table 3 and Table 2, respectively, show additional count rate decreases in case 3 relative to the after frac data with the tag only in the fracture (case 2). The fact that we see no significant effect of the tagged proppant slurry in the borehole region on the fm-sigma curve, but we do see the effect of the added borehole region proppant on both the A-fm×Tau-fm curve and on the gate count rate curves (big decreases), is providing a way to distinguish whether most of the proppant tag is in the near borehole region relative to that in the fracture itself. If there is tagged proppant in both the fracture and the near borehole region, the formation sigma will increase, and the formation component count rate related parameters (A-fm×Tau-fm and the gated counts) will decrease. With tagged proppant in the borehole region only (case 4), the formation sigma does not change much from the pre-frac case, but both gated count rates and formation component count rate related parameters decrease, although, not as much as if the tagged proppant/sand had also been out in the formation fracture. There should be a gradation of this effect as well, with sigma-formation gradually increasing (relative to the observed decreases in the gated count rates and count rate related parameters) as the percentage of the detected frac slurry present in the fracture relative to the borehole/cement region increases.

Figure 7:
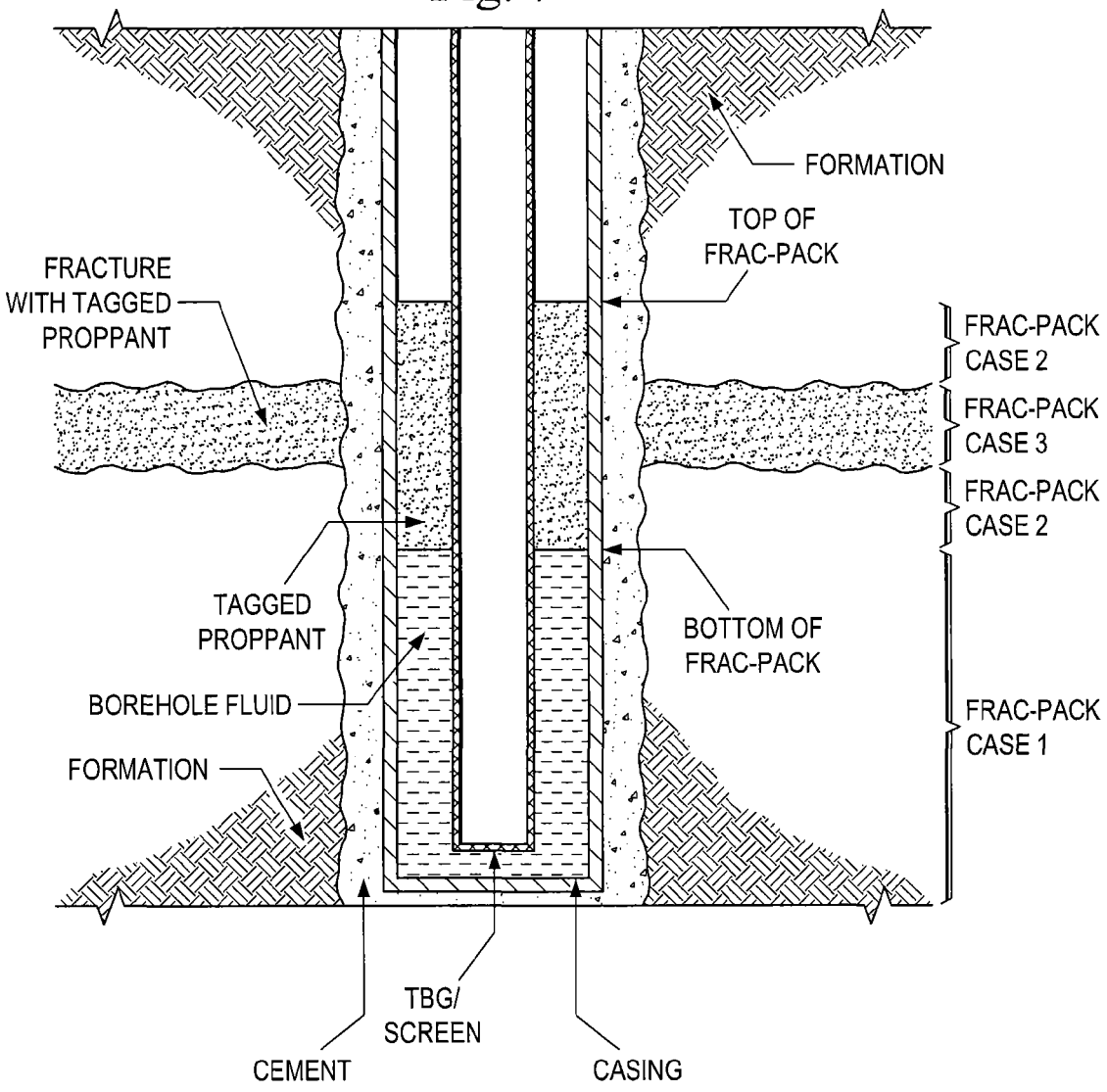
FIG. 7 shows modeled wellbore geometry for a frac-pack operation where Gd tagged proppant/sand has been utilized in the fracturing and packing procedure. Tagged proppant has been placed in formation fractures and/or in the annular space between the casing and an interior screen/liner. The geometry modeled in this figure with proppant only in the annular space is also the geometry in a typical cased-hole gravel-pack operation.

Scenario 2—Cased-Hole Frac-Pack Application:

Since the situation in a frac-pack is somewhat analogous to the situation described in scenario 1 above, the depth of proppant concept is also applicable to qualitatively and quantitatively determining radial proppant location related to cased-hole frac-pack operations in a vertical (or deviated or possibly horizontal) well. Detected parameters will include: the location of top and bottom of the frac-pack, the relative quality/location of frac-pack material inside the casing, and the location and height of the packed interval (primarily including the fracture) outside of the casing. Described herein are several modeled proppant placement situations related to frac-pack operations (same formation, borehole, and taggant as in Scenario 1). As seen in FIG. 7, the first frac-pack geometry (frac-pack case 1) has is no tagged proppant present in the borehole region or in the formation. The annular space between the well casing and the tubing/screen/liner is filled with fluid, as is the annular space adjacent to the logging tool (tool not shown) inside the screen. For this frac-pack case, which is also the situation throughout the entire logged interval prior to the frac-packing operation, the measured values of formation sigma, borehole sigma, A-fm×Tau-fm, A-bh×Tau-bh, and the gate count rates are the "true" or "reference" or "baseline" values of formation and borehole decay parameters and the gate count rates.

Frac-pack case 2 in FIG. 7 has neutron absorber tagged proppant (or tagged sand), which comprises the aforementioned frac-pack particles within the overall frac-pack slurry, only present inside the casing in the frac-pack zone annulus outside the tubing/screen/liner. Compared to frac-pack case 1, little or no change in the formation sigma was observed, and should not be expected since there is no proppant outside the casing (see Table 5 data), but the borehole sigma is seen to increase significantly. The increase in sigma borehole is observed since now the frac-packed region dominates the overall region inside the casing, and since fresh water was modeled as the borehole fluid in frac-pack case 1 (the situation prior to proppant placement). This proppant-related increase in sigma borehole ($\Sigma_{bh}$) in frac-pack case 2 will be reduced (or possibly not observed) with higher and higher salinities of the borehole fluid in frac-pack case 1 prior to proppant placement. The A×Tau component count rate values and the gated capture gamma ray count rates also exhibit large changes (decreases) relative to the situation in frac-pack case 1 (see Tables 5 and 4). The fact that we see no significant effect of the added tagged proppant slurry in the borehole region/annulus on the fm-sigma curve, but we do see the effect of the added borehole proppant/sand on $\Sigma_{bh}$ and on the A-fm×Tau-fm and A-bh×Tau-bh curves, and also on the gate count rate curves (big decreases), is providing a way to determine when most of the tagged proppant is in packed into the annular space between the screen and the well casing relative to that in the frac-pack region and fracture outside the casing. Increases in the observed $\Sigma_{bh}$ and decreases in the A×Tau parameters and/or in the gated count rates, relative to the values of those parameters relative to frac-pack case 1, indicate the quality and consistency of the pack in the annular space. Larger decreases in the count rate parameters and larger increases in $\Sigma_{bh}$ relative to case 1 indicate better filling of the annular space containing the tagged proppant or sand. If the magnitudes of the anticipated changes in these parameters as a function of percent fill can be determined, modeled, or otherwise calibrated ahead of time for the given borehole and casing/liner conditions in a given field situation, the percent frac-pack fill in the annular space between the casing and liner can be determined. If calibration is not available, then relative changes on the field log of these parameters will qualitatively indicate the amount of fill.

TABLE 4

Decreases and % changes in modeled PNC count rates in selected time gates for frac-pack geometry cases 1-3 in FIG. 7

| Time gate after | Case 1 | | Case 2 | | Case 3 | |
|---|---|---|---|---|---|---|
| burst (μSec) | Near | Far | Near | Far | Near | Far |
| Capture Gamma Ray Counts in Time Gate | | | | | | |
| 400-1000 | 3.58E−06 | 5.35E−07 | 1.40E−06 | 2.40E−07 | 5.52E−07 | 1.14E−07 |
| 500-1000 | 1.86E−06 | 3.35E−07 | 8.09E−07 | 1.42E−07 | 3.04E−07 | 6.80E−08 |
| 600-1000 | 1.03E−06 | 1.93E−07 | 4.52E−07 | 8.01E−08 | 1.68E−07 | 3.93E−08 |
| Percentage Change in Counts Relative to Before Frac Case | | | | | | |
| 400-1000 | | | −61% | −55% | −73% | −64% |
| 500-1000 | | | −57% | −58% | −71% | −66% |
| 600-1000 | | | −56% | −58% | −70% | −65% |

TABLE 5

PNC Measurement parameters for frac-pack geometry in frac-pack cases 1-3 in FIG. 7

| | $A_{fm}$ | $Sig_{fm}$ (cu) | $A_{fm}*t_{for}$ | $A_{bh}$ | $Sig_{bh}$ (cu) | $A_{bh}*t_{bh}$ |
|---|---|---|---|---|---|---|
| Case 1 | 281.02 | 24.51 | 52169.72 | 917.75 | 53.49 | 78063.03 |
| Case 2 | 112.16 | 23.77 | 21473.13 | 962.53 | 117.60 | 37242.00 |
| Case 3 | 62.17 | 26.20 | 10798.75 | 1297.07 | 135.86 | 43440.24 |

Figure 8:
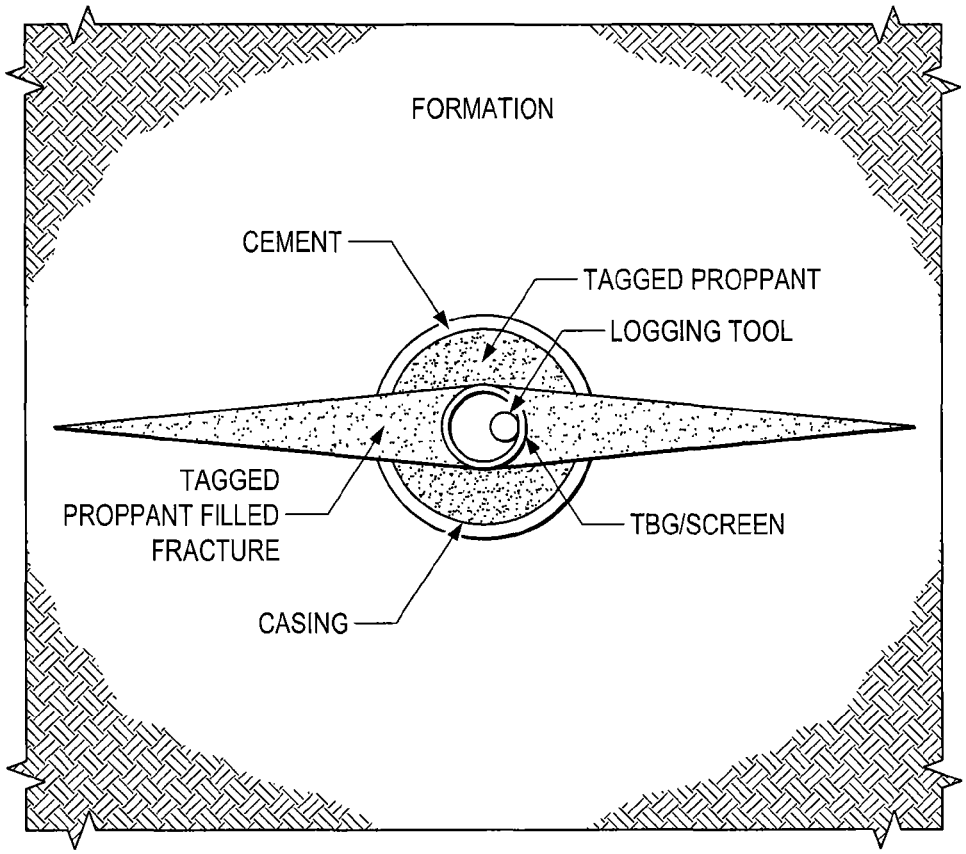
FIG. 8 shows a top view (perpendicular to borehole axis) modeled geometry in a frac-pack operation in which Gd tagged pack material is placed in the fractured region in the formation and also in the frac-pack annular space between the well casing and an interior screen/liner.

Frac-pack case 3 has tagged proppant present in both the annulus between the screen and well casing, and also packed into the fractured region and fractures outside the casing. The modeled geometry of frac-pack case 3 is shown in both FIGS. 7 and 8; the modeled gate count rate results are given in Table 4, and the modeled PNC formation and borehole parameters are given in Table 5. In this situation, an increase in formation sigma is observed relative to frac-pack cases 1 and 2, where there is no tagged proppant/sand outside the casing. The increase in formation sigma can be used to distinguish this situation from frac-pack case 2 mentioned above, and to uniquely identify the presence of the frac-pack material outside the well casing/borehole region. The magnitude of the increase in formation sigma will be directly related to the amount of frac-pack material present outside the well casing/borehole region. The A×Tau values and the gated count rates in frac-pack case 3 show additional decreases relative to the after-pack data with the tag only in the annular space inside the casing (frac-pack case 2). When there is tagged proppant in the fractures in the frac-pack region outside the casing, and also inside the borehole in the annular space between the screen and casing, the formation sigma will increase, the borehole sigma will also probably increase (depending on frac-pack case 1 borehole fluid salinity), and the formation component count rate related parameters (A-fm×Tau-fm and the gated count rates) will decrease, all relative to their respective values in the baseline case (frac-pack case 1). Similar to the situation above in frac-pack case 2, the magnitude of the gated count rate and formation decay component count rate decreases relative to the pre-pack situation in frac-pack case 1, and the increases in sigma borehole, are related to the quality of the overall frac-pack both inside and outside the well casing. A summary of the expected changes in the observed parameters for the frac-pack scenario is presented in Table 6. The relative magnitude of the increases in formation sigma between cases 1 and 3, as compared to the relative decreases in the formation component count rate related parameters, or compared to the increases in sigma borehole, will be indicative of how much tagged proppant is located outside the casing in fractures relative to proppant inside the casing in the frac-pack annular space.

TABLE 6

Expected changes in PNC parameters in Frac-pack cases 1-3 in FIG. 7

| | Sigma-formation | Sigma-borehole | A-fm x Tau-fm | Gated count rate |
|---|---|---|---|---|
| Frac-pack Case 1 | Baseline | Baseline | Baseline | Baseline |
| Frac-pack Case 2 | ~No change | Probable increase* | Decrease | Decrease |
| Frac-pack Case 3 | Increase | Probable slightly larger increase* | Additional decrease | Additional decrease |

Figure 9:
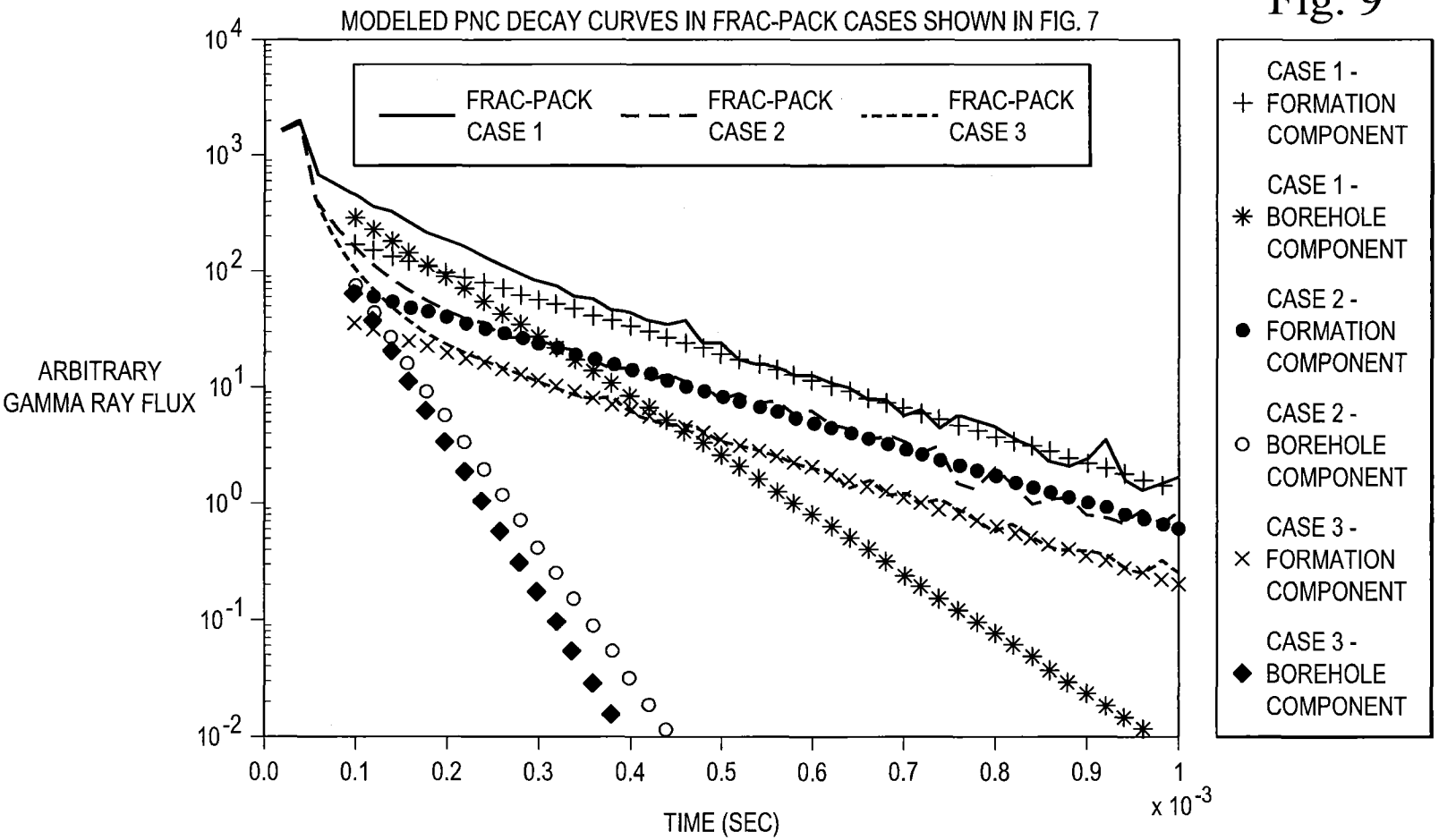
FIG. 9 shows modeled PNC decay curves in the three frac-pack cases illustrated in FIG. 7. Formation and borehole decay components computed from the modeled decay curves are also shown.
Figure 10:
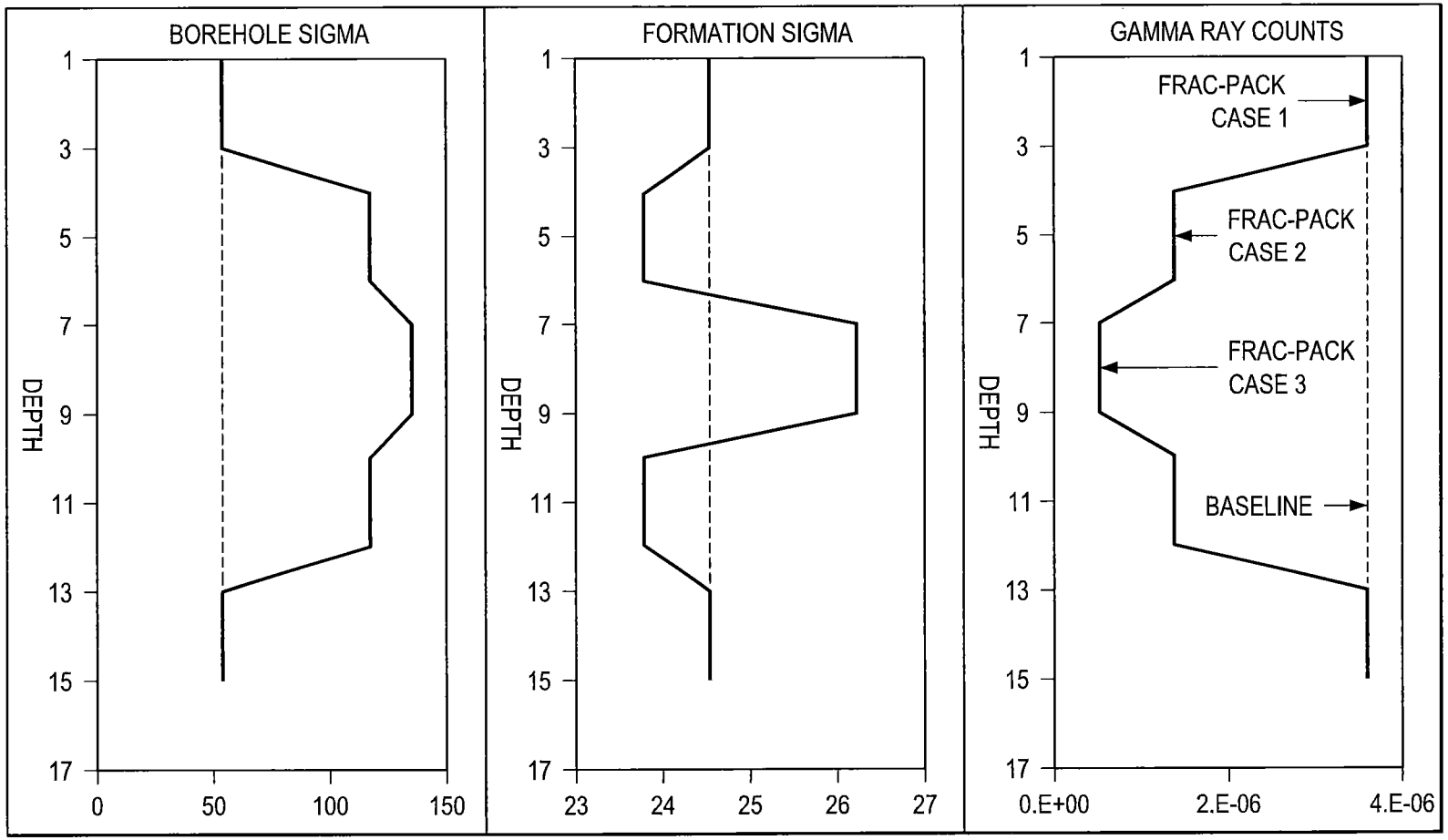
FIG. 10 shows a simulated log of modeled PNC near-spaced detector formation and borehole component capture cross-sections, and near detector count rates in a time interval following (i.e. between) the neutron bursts, for the modeled frac-pack cases in FIG. 7.

*Amount of increase will be related to the salinity of the borehole fluid in baseline case The frac-pack scenario can be further illustrated in modeled decay curves computed using the geometries for the three cases in FIG. 7. These decay curves are shown in FIG. 9, and a synthetic log showing computed parameter values for the three cases is given in FIG. 10. In the baseline case, there is no tagged proppant present in the annular borehole region or in the formation. Prior to the frac-pack operation, the borehole outside the tubing/screen is filled with a fluid (generally water-based or oil-based), as is the annular space inside the tubing/screen adjacent to the logging tool (not shown). For this baseline case (Frac-pack case 1), which exists prior to the frac-pack operation, the measured values of formation sigma, borehole sigma, A-fm×Tau-fm, A-bh×Tau-bh, and the gated count rates are the "true" or "reference" or "baseline" values.

In the second frac-pack case (case 2), tagged proppant/sand is only present in the annular space between the screen and the casing. Compared to the baseline case, little or no change was observed in the computed formation sigma, but the borehole sigma significantly increased. The amount of increase in $\Sigma_{bh}$ will be inversely related to the salinity of the fluid present in the baseline case. On the other hand, the formation component A×Tau values and the gated capture gamma ray count rates exhibited significant decreases relative to the baseline case. The fact that we see no significant effect of the added tagged proppant slurry in the borehole region/annulus on the formation-sigma curve, but we do see the effect of the added borehole proppant on the A-fm×Tau-fm curve (and on the A-bh×Tau-bh curve, not shown), and also on the gated count rate curves (big decreases), is providing a way to determine the amount/extent of tagged proppant present and packed into the annular space between the tubing/screen and the well casing. If the magnitudes of the anticipated changes in these parameters as a function of percent fill can be determined, modeled, or otherwise calibrated ahead of time for the given borehole and casing conditions in a field situation, the percent fill in the annular space in the field situation can be determined. If calibration is not available, then relative parameter changes observed on the field log will qualitatively indicate the amount of fill. It should be noted that in gravel pack scenario (see discussion in scenario 2a, below), if there is no attempt made to fracture the formation when the proppant/sand/gravel is placed in the annular space outside the tubing/screen, the same interpretation methods can be used to provide information indicating the amount of fill present in the gravel pack.

The third frac-pack case (case 3) has tagged proppant present in the annulus between the tubing/screen and casing, and also packed into a fracture extending into the formation. In this situation, there will be a change (increase) in formation sigma relative to case 2, in which there is no tagged proppant in any fractures in the formation. The increase in formation sigma can be used to distinguish this situation from case 2, and to uniquely identify the presence of the tagged proppant in the fracture outside the borehole annular region. The magnitude of the increase in formation sigma will be directly related to the amount of tagged proppant present in fractures in the formation. In case 3 the A×Tau formation component count rate values and the gated count rates show additional decreases relative to the after-frac data with the tagged pack material only in the annular space (case 2). When there is tagged proppant in vertical fractures outside the borehole and also in the annular space between the tubing/screen and well casing (case 3), the formation sigma will increase, and the A×Tau component count rates and the gated count rates will decrease, all relative to the baseline case.

Scenario 2a—Cased-Hole Gravel Pack Application

It is important to note that in a conventional gravel packing operation, where essentially all of the pack material (comprising a gravel-pack slurry containing gravel-pack particles) is located in the annulus between the casing and screen (i.e. little or no pack material is intentionally placed outside the casing), the gravel pack geometry is identical to the geometry in frac-pack case 2 above, and the pre-gravel pack geometry is the same as the geometry in frac-pack case 1. Hence the comments above relating to determining the quality of fill in the frac-packed region in the annulus between the screen and casing by comparing changes in PNC measurements of sigma borehole, the A×Tau component count rates, and/or the time gated count rates between frac-pack case 1 and frac-pack case 2 equally well applies to interpreting percent fill in a gravel pack annulus when the gravel pack material contains a neutron absorber/tag, such as boron carbide or gadolinium oxide. On the other hand, since the PNC sigma formation measurements are not significantly affected by annular fill between the screen and casing, that measurement would be of little value in locating gravel in the annulus in conventional gravel pack applications. It should also be noted that prior MCNP modeling for interpreting neutron absorber tagged gravel packs using data from a compensated neutron tool (CNT) gave unreliable results, since CNT detector count rate decreases due to the neutron absorber/tag material in the proppant/sand in the gravel pack are partially or fully offset by CNT count rate increases when gravel is present due to the lower hydrogen index of the gravel pack material relative to the water in the annulus prior to pack placement. Hence, CNT count rate changes are difficult or impossible to interpret in determining % fill in frac-packs or gravel packs when the pack material contains a strong thermal neutron absorber. Since CNT tools are not well suited to tagged gravel applications, this gives added significance to the fact that PNC tools are able to evaluate percent fill in the casing-screen annulus in frac-packs and gravel packs when a neutron absorber is added into or onto the pack material.

Scenario 3—Uncased Liner (Including Horizontal Well) Fracturing, Frac-Packing, and Gravel Packing Applications:

This geometry in this scenario (see FIG. 11) involves a horizontal (or possibly vertical) well in which is placed an uncemented liner that is perforated and/or contains a sliding sleeve, enabling proppant to fill the borehole annulus outside the liner (alternatively in a frac-pack or gravel pack operation the liner may be replaced by a gravel pack screen). In addition, at discrete depths along the horizontal open-hole section, a transverse (or possibly axial) fracture is created that extends into the formation. The baseline (first) case here is analogous to the baseline case for the frac-pack scenario, i.e., there is no tagged proppant present in the annular borehole region or in the formation. Prior to a liner/screen frac or frac-pack operation, the borehole outside the liner/screen is filled with a fluid (generally water-based or oil-based), as is the annular space inside the line/screenr adjacent to the logging tool (not shown). For this baseline case (Horizontal case 1), which exists prior to the frac or frac-pack operation, the measured values of formation sigma, borehole sigma, A-fm×Tau-fm, A-bh×Tau-bh, and the gated count rates are the "true" or "reference" or "baseline" values.

In the second horizontal well case (Horizontal case 2), tagged proppant/sand is only present in the open-hole annular space between the liner/screen and the borehole wall. Compared to the baseline case, little or no change will be observed in the computed formation sigma, but the borehole sigma will significantly increase. The amount of increase in $\Sigma_{bh}$ will be inversely related to the salinity of the fluid present in the baseline case (as in the frac-pack scenario 2 above), and will also be related to how closely the tool diameter (OD) approaches the inside wall diameter (ID) of the liner/screen. On the other hand, the formation component A×Tau values and the gated capture gamma ray count rates will exhibit significant decreases relative to the baseline case. We should see no significant effect of the added tagged proppant slurry in the borehole region/annulus on the formation-sigma curve, but we should see the effect of the added borehole proppant on the A-fm×Tau-fm curve, on the A-bh×Tau-bh curve, and also on the gated count rate curves (big decreases). These changes between the before-frac and after-frac logs, are providing a way to determine the amount of tagged proppant present and packed into the annular space between the liner/screen and the borehole wall. If the magnitudes of the anticipated changes in these parameters as a function of percent fill can be determined, modeled, or otherwise calibrated ahead of time for the given borehole and liner/screen conditions in a field situation, the percent fill in the annular space in the field situation can be determined. If calibration is not available, then relative parameter changes observed on the field log will qualitatively indicate the amount of fill. It should be noted that, similar to the cased-hole gravel pack scenario discussed above, if there is no attempt made to fracture the formation when the proppant/sand/gravel is placed in the annular open-hole space outside the liner/screen, the horizontal well frac or frac-pack scenario in Horizontal case 2 is identical to an analogous open-hole gravel pack situation in either a horizontal, deviated, or vertical borehole, and the same interpretation methods can be used to provide information indicating the amount of fill present in the gravel pack.

The third horizontal well fracturing case (Horizontal case 3) has tagged proppant present in the annulus between the liner/screen and borehole wall, and also packed into a fracture extending into the formation. In this situation, there will be a change (increase) in formation sigma relative to Horizontal case 2, in which there is no tagged proppant in any fractures in the formation. The increase in formation sigma can be used to distinguish this situation from Horizontal case 2, and to uniquely identify the presence of the tagged proppant in the fracture outside the borehole annular region. The magnitude of the increase in formation sigma will be directly related to the amount/extent of tagged proppant present in fractures in the formation. In Horizontal case 3, the A×Tau component count rate values and the gated count rates all will show additional decreases relative to the after-frac data with the tagged pack material only in the annular space (Horizontal case 2). When there is tagged proppant in vertical fractures outside the uncased borehole and also in the annular space between the line/screenr and borehole wall (Horizontal case 3), the formation sigma will increase, and the component count rates (A×Tau for fm or bh components) and the gated count rates will decrease, all relative to the baseline case. When the vertical fracture plane transversely (as shown in FIG. 11) or obliquely intersects the horizontal wellbore, the PNC tool response to the material in the fracture will only be sensed along a very short interval (~1-3 ft) of the wellbore, while the source and detectors are moving past the fracture.

Observing proppant in a fracture in this transverse/oblique situation (i.e., with the fracture plane at an angle to the borehole axis) will likely require slower logging speeds and higher data sampling rates in order to fully capture the log response (unless there are multiple closely spaced ~parallel fractures present). It should be noted that in Horizontal case 3, with the fracture plane aligned with the borehole axis, the geometry is exactly the same as would be present in an open-hole liner frac-pack in a vertical well, and the interpretation involved would be the same, and would be generally similar to that in frac-pack case 3, in scenario 2 above.

Although the above discussion has focused on comparing pre-frac with post-frac logs to detect the location of proppant tagged with high thermal neutron capture cross section materials (e.g. $B_4C$ or $Gd_2O_3$) to indicate induced fractures or the presence of proppant in frac-pack and gravel-pack operations, a similar comparison of two (or more) PNC logs run at different times after the frac job can also provide useful information. If there is a reduction over time in the amount of tagged proppant in the fracture and/or borehole region, a reversal of the changes described above will be observed between a post-frac log run at one point in time after the frac operation with a similar log run at a later time (after making any required log normalization). Decreases in $\Sigma_{fm}$ and/or $\Sigma_{bh}$, and increases in $A_{fm}*\tau_{fm}$ and gated count rates, would indicate a reduction in the amount of tagged proppant/sand detected when the later post-frac log was run. This reduction in the amount of proppant in place can provide useful information about the well. Any proppant reduction is likely caused by proppant being produced out of the well together with the oilfield fluids produced from the formation. Proppant reduction could indicate that the fracture, frac-pack, or gravel pack is not as well filled with the packing material as it was initially (and hence the possible requirement for another frac job or other remedial action). Reduced proppant in the formation could also indicate the fractured zones from which most of the production is coming, since proppant will likely only be produced from producing zones. No change in formation proppant could conversely be indicative of zones that are not producing, and hence provide information about zones that need to be recompleted. Since PNC tools are used for these comparisons, it is also be possible to distinguish whether the proppant changes are coming from the frac-pack zone in the borehole or the formation fractures themselves, or both. If logs are run at multiple times after the first post-fracture log, then progressive changes could be monitored. Of course, it would also be useful to know whether a reduction in proppant detected was caused by a reduction in the quality of the propped fracture or caused by the zones with the highest production rates, or both. Resolving these effects might be possible by augmenting the post-frac proppant identification logs with: (1) conventional production logs, (2) gamma ray logs to locate radioactive salt deposition in zones resulting from production, (3) acoustic logs to detect open fractures, (4) other log data, and/or (5) field information. It should be noted that this type of post-frac information could not be obtained using fracture identification methods in which relatively short half life radioactive tracers are pumped downhole, since radioactive decay would make the subsequent post-frac logs useless. This would not be a problem with the methods described, since the characteristics/properties of boron or gadolinium tagged proppants do not change over time.

The foregoing detailed description is to be clearly understood as being given by way of illustration and example only, the spirit and scope of the present invention being limited solely by the appended claims.

What is claimed is:

1. A method for determining the location and height of frac-pack particles placed inside a casing of a cased borehole and in fracture(s) in a subterranean formation as a result of a frac-pack procedure, comprising:

utilizing a frac-pack slurry comprising a liquid and frac-pack particles to hydraulically fracture the subterranean formation to generate a fracture and to place the particles into the fracture and also into a frac-pack zone portion of the cased borehole in the vicinity of the fracture, wherein all or a fraction of such frac-pack particles includes a thermal neutron absorbing material;

obtaining a post-frac-pack data set by:

(i) lowering into the borehole traversing the subterranean formation a pulsed neutron capture logging tool comprising a pulsed neutron source and a detector, (ii) emitting pulses of neutrons from the last-mentioned neutron source into the borehole and the subterranean formation, (iii) detecting in the borehole thermal neutrons or capture gamma rays resulting from nuclear reactions in the borehole and the subterranean formation, and (iv) measuring a capture cross-section of a borehole component and a time gated count rate from borehole and formation decay, wherein the time gated count rate from borehole and formation decay is measured within a time gate interval more than 400 μsec after the end of the neutron pulse;

utilizing the post-frac-pack data set to determine the location of the frac-pack particles inside the casing; and correlating the location of the frac-pack particles to a depth measurement of the borehole to determine at least one selected from the group consisting of the location, axial distribution, radial distribution, and height of frac-pack particles placed inside the casing in the vicinity of the fracture and to assist in determining the location and height of the fracture(s) in the formation.

2. The method of claim 1 wherein the frac-pack particles are selected from the group consisting of ceramic proppant, sand, resin coated sand, plastic beads, glass beads, and resin coated proppants.

3. The method of claim 1 wherein the frac-pack slurry containing the thermal neutron absorbing material has a thermal neutron capture cross-section exceeding that of the subterranean formation.

4. The method of claim 1 wherein the frac-pack slurry containing the thermal neutron absorbing material has a thermal neutron capture cross-section of at least about 90 capture units.

5. The method of claim 1 wherein the thermal neutron absorbing material comprises at least one element selected from the group consisting of boron, cadmium, gadolinium, iridium, samarium, and mixtures thereof, wherein the thermal neutron absorbing material comprising gadolinium is selected from the group consisting of gadolinium oxide, gadolinium acetate, high gadolinium concentrated glass, and mixtures thereof.

6. The method of claim 5 wherein the thermal neutron absorbing material is $Gd_2O_3$.

7. The method of claim 1 wherein the thermal neutron absorbing material is present in an amount from about 0.025% to about 4.0% by weight of the frac-pack particles.

8. The method of claim 1 wherein the frac-pack particles are granular, with substantially every grain having the thermal neutron absorbing material integrally incorporated therein or coated thereon.

9. The method of claim 8 wherein the frac-pack particles have a coating thereon, and the thermal neutron absorbing material is disposed in the coating.

10. The method of claim 1 wherein the frac-pack particles inside the casing are placed in the annular space between an interior wall of the casing and an outer wall of an interior liner or screen inside the casing.

11. The method of claim 1 wherein the frac-pack particles have a coating thereon, and the thermal neutron absorbing material is disposed in the coating.

12. The method of claim 11 wherein the coating is a resin coating.

13. The method of claim 1 further comprising:

obtaining a pre-frac-pack data set resulting from:

(i) lowering into the borehole traversing the subterranean formation a pulsed neutron capture logging tool comprising a neutron source and a detector, (ii) emitting pulses of neutrons from the neutron source into the borehole and the subterranean formation, (iii) detecting in the borehole thermal neutrons or capture gamma rays resulting from nuclear reactions in the borehole and the subterranean formation, and (iv) measuring a capture cross-section of the borehole component and a time gated count rate from borehole and formation decay, wherein the time gated count rate from borehole and formation decay is measured within a time gate interval more than 400 μsec after the end of the neutron pulse;

comparing the post-frac-pack data set and the pre-frac-pack data set; and observing from the post-frac-pack data set a decrease in the time gated count rate from borehole and formation decay and/or an increase in the capture cross-section of the borehole component compared to that of the pre-frac-pack data set as an indicator of the presence of the frac-pack particles inside the casing.

14. The method of claim 13 wherein the pre-frac-pack and post-frac-pack data sets further comprise, measuring at least one of a capture cross-section of a formation component and an early time gated count rate from borehole and formation decay, wherein the early time gated count rate from borehole and formation decay is measured during a nearly gate interval between an end of a neutron pulse to about 400 μsec after the end of the neutron pulse; and further comprising:

using differences in relative radial sensitivities of each of the capture cross-section of the borehole component, the capture cross-section of the formation component, the time gated count rate, and the early time gated count rate to improve an estimate of the location of the frac-pack particles inside the casing and/or to distinguish the frac-pack particles inside the casing from any frac-pack particles outside the casing.

15. The method of claim 14 wherein the pre-frac-pack and post-frac-pack data sets each comprise measuring the early time gated count rate from borehole and formation decay; and further comprising:

using differences in radial sensitivities of the early time gated count rates relative to the time gated count rates to improve an estimate location of the frac-pack particles inside the casing.

16. The method of claim 14 wherein said distinguishing the frac-pack particles inside the casing from those outside the casing utilizes (1) the sensitivity of the capture cross-section of the formation to frac-pack particles placed in the formation and its relative insensitivity to frac-pack particles placed inside the casing, (2) the sensitivity of the detected time gated count rates from borehole decay formation decay to frac-pack particles in both the formation and inside the casing, and (3) the relative insensitivity of the capture cross-section of the borehole to frac-pack particles placed in the formation, including fractures in the formation, relative to frac-pack particles placed inside the casing.

17. The method of claim 14 wherein the distinguishing the frac-pack articles inside the casing from those outside the casing additionally includes a calibration procedure to indicate the quality and/or percent fill of the frac-pack particles placed inside the casing.

18. The method of claim 17 wherein the frac-pack particles inside the casing are placed in the annular space between an interior wall of the casing and an outer wall of an interior liner or screen inside the casing.

19. The method of claim 17 wherein the calibration procedure comprises modeling a percent fill of frac-pack particles inside the cased borehole based on a simulation utilizing field conditions of the borehole, the formation and the casing to provide a frac-pack model yielding magnitudes of anticipated changes in at least one of the capture cross-section of the borehole component and the time gated count rate from borehole and formation decay as a function of the modeled percent fill of the modeled frac-pack particles hydraulically aced into a region inside the cased borehole.

20. The method of claim 14 wherein thee count rates measured in the post-frac-pack data set decrease in the time gate interval and increase in the early time gate interval compared to the count rates measured in the pre-frac-pack data set.

21. The method of claim 14 wherein, in at least one of the obtaining steps, the detector comprises a thermal neutron detector and/or a gamma ray detector.

22. The method of claim 21 wherein the gamma ray detector comprises a gamma ray spectroscopy detector, the gamma ray spectroscopy detector configured to process capture gamma rays emitted from inside the casing and from the formation.

23. The method of claim 14 wherein the time gated count rate and the early time gated count rate are replaced by a single time gated count rate encompassing both the borehole decay and the formation decay measured between adjacent neutron pulses.

24. The method of claim 13 further comprising normalizing the pre-frac-pack and post-frac-pack data sets prior to comparing the pre-frac-pack data set and the post-frac-pack data set.

25. The method of claim 24 wherein the normalizing step includes the step of obtaining pre-frac-pack data and post-frac-pack data in an interval outside of the frac-pack zone.

26. The method of claim 13 wherein the same or an identical pulsed neutron capture logging tool is used in each of the obtaining steps.

27. A method for determining the location and height of gravel-pack particles placed in a gravel-pack zone inside a casing of a cased borehole within a subterranean formation as a result of a gravel-pack procedure, comprising:

utilizing a gravel-pack slurry comprising a liquid and gravel-pack particles to hydraulically place the particles into a region of the cased borehole, wherein all or a fraction of such gravel-pack particles includes a thermal neutron absorbing material;

obtaining a post-gravel-pack data set by:

(i) lowering into the borehole traversing a subterranean formation a pulsed neutron capture logging tool comprising a pulsed neutron source and a detector, (ii) emitting pulses of neutrons from the last-mentioned neutron source into the borehole and the subterranean formation, (iii) detecting in the borehole thermal neutrons or capture gamma rays resulting from nuclear reactions in the borehole and the subterranean formation, and (iv) measuring a capture cross-section of a borehole component and a time gated count rate from borehole and formation decay, wherein the time gated count rate from borehole and formation decay is measured within a time gate interval more than 400 μsec after the end of the neutron pulse;

utilizing the post-gravel-pack data set to determine the location of the gravel-pack particles; and correlating the location of the gravel-pack particles to a depth measurement of the borehole to determine the location, height, and/or percent fill of gravel-pack particles placed in the gravel-pack zone inside the casing.

28. The method of claim 27 wherein the gravel-pack particles are selected from the group consisting of ceramic proppant, sand, resin coated sand, plastic beads, glass beads, and resin coated proppants.

29. The method of claim 27 wherein the gravel-pack slurry containing the thermal neutron absorbing material has a thermal neutron capture cross-section exceeding that of the subterranean formation.

30. The method of claim 27 wherein the gravel-pack slurry containing the thermal neutron absorbing material has a thermal neutron capture cross-section of at least about 90 capture units.

31. The method of claim 27 wherein the thermal neutron absorbing material comprises at least one element selected from the group consisting of cadmium, gadolinium, iridium, samarium, and mixtures thereof, wherein the thermal neutron absorbing material comprising gadolinium is selected from the group consisting of gadolinium oxide, gadolinium acetate, high gadolinium concentrated glass, and mixtures thereof.

32. The method of claim 27 wherein the thermal neutron absorbing material is present in an amount from about 0.025% to about 4.0% by weight of the gravel-pack particles.

33. The method of claim 27 wherein the gravel pack particles are granular, with substantially every particle grain having the thermal neutron absorbing material integrally incorporated therein or coated thereon.

34. The method of claim 33 wherein the thermal neutron absorbing material is $Gd_2O_3$.

35. The method of claim 33 wherein the gravel pack particles have a coating thereon, and the thermal neutron absorbing material is disposed in the coating.

36. The method of claim 27 wherein the gravel-pack particles have a coating thereon, and the thermal neutron absorbing material is disposed in the coating.

37. The method of claim 36 wherein the coating is a resin coating.

38. The method of claim 27, wherein said correlating step additionally includes a calibration procedure to determine the quality and/or percent fill of the gravel-pack particles placed in the gravel-pack zone inside the casing.

39. The method of claim 38 wherein the calibration procedure comprises modeling a percent fill of gravel-pack particles inside the cased borehole based on a simulation utilizing field conditions of the borehole, the formation, and the casing to provide a gravel-pack model yielding magnitudes of anticipated changes in at least one of the capture cross-section of the borehole component and the time gated count rate from borehole and formation decay as a function of the modeled percent fill of the modeled gravel-pack particles hydraulically placed into a region inside the cased borehole.

40. The method of claim 27, wherein, in at least one of the obtaining steps, the detector comprises a thermal neutron detector and/or a gamma ray detector.

41. The method of claim 40 wherein the gamma ray detector comprises a gamma ray spectroscopy detector, the gamma ray spectroscopy detector configured to process capture gamma rays emitted from the borehole region and the formation.

42. The method of claim 27 further comprising:

obtaining a pre-gravel-pack data set resulting from (i) lowering into the borehole traversing the subterranean formation a pulsed neutron capture logging tool comprising a neutron source and a detector, (ii) emitting pulses of neutrons from the neutron source into the borehole and the subterranean formation, (iii) detecting in the borehole thermal neutrons or capture gamma rays resulting from nuclear reactions in the borehole and the subterranean formation, and (iv) measuring a capture cross-section of the borehole component and a time gated count rate from borehole and formation decay, wherein the time gated count rate from borehole and formation decay is measured within a time gate interval more than 400 μsec after the end of the neutron pulse;

comparing the post-gravel-pack data set from the pre-gravel-pack data set; and observing from the post-gravel-pack data set a decrease in the time gated count rate from borehole and formation decay and/or an increase in the capture cross-section of the borehole component compared to that of the pre-gravel-pack data set as an indicator of the presence of the gravel-pack particles inside the casing.

43. The method of claim 42 further comprising normalizing the pre-gravel-pack and post-gravel-pack data sets prior to comparing the pre-gravel-pack data set and the post-gravel-pack data set.

44. The method of claim 43 wherein the normalizing step includes the step of obtaining pre-gravel-pack data and the post-gravel-pack data in an interval outside of the gravel-pack zone.

45. The method of claim 42 wherein the pre-frac-pack and post-frac-pack data sets further comprise measuring at least one of a capture cross-section of a formation component and an early time gated count rate from borehole and formation decay, wherein the early time gated count rate from borehole and formation decay is measured during an early time gate interval between an end of a neutron pulse to about 400 μsec after the end of the neutron pulse; and further comprising;

using differences in relative radial sensitivities of each of the capture cross-section of the borehole component, the capture cross-section of the formation component the time gated count rate, and the early time gated count rate to improve an estimate of the location of the gravel-pack particles inside the casing and/or to distinguish the gravel-pack particles inside the casing from any gravel-pack particles outside the casing.

46. The method of claim 45 wherein improving the estimate location of the gravel-pack particles utilizes (1) the sensitivity of the capture cross-section of the formation to any gravel-pack particles placed outside the casing and its relative insensitivity to gravel-pack particles placed inside the casing, (2) the sensitivity of the detected time gated count rates from borehole decay and formation decay to gravel-pack particles inside the casing and outside the casing and (3) the sensitivity of the capture cross-section of the borehole to gravel-pack particles placed inside the casing and its relative insensitivity to any gravel-pack particles placed outside the casing.

47. The method of claim 45 wherein the pre-gravel-pack and post-gravel-pack data sets each comprise measuring the early time gated count rate from borehole and formation decay; and further comprising:

using differences in radial sensitivities of the early time gated count rates relative to the time gated count rates to improve an estimate location of the gravel-pack particles inside the casing.

48. The method of claim 45 wherein the count rates measured in the post-gravel-pack data set decrease in the time gate interval and increase in the early time gate interval compared to the count rates measured in the pre-gravel-pack data set.

49. The method of claim 45 wherein the time gated count rate and the early time gated count rate are replaced by a single time gated count rate encompassing both the borehole decay and the formation decay measured between adjacent neutron pulses.

50. The method of claim 27 wherein the gravel-pack-particles in the gravel-pack zone are placed in the annular space between an interior wall of the casing and an outer wall of an interior liner or screen inside the casing.

51. The method of claim 27 wherein said correlating step additionally includes a calibration procedure to determine the quality and/or percent fill of the gravel-pack particles placed in the gravel-pack zone.

52. A method for determining the quality and consistency of a gravel-pack placed inside a casing of a cased borehole within a subterranean formation as a result of a gravel-pack procedure, comprising:

modeling a percent fill of gravel pack particles in the cased borehole based on a simulation utilizing conditions of the borehole and the casing to provide a gravel-pack model;

utilizing a gravel-pack slurry comprising a liquid and gravel-pack particles to hydraulically place the particles into a region of the cased borehole, wherein all or a fraction of such gravel-pack particles includes a thermal neutron absorbing material;

obtaining a post-gravel-pack data set by:

(i) lowering into the borehole traversing a subterranean formation a pulsed neutron capture logging tool comprising a pulsed neutron source and a detector, (ii) emitting pulses of neutrons from the last-mentioned neutron source into the borehole and the subterranean formation, and (iii) detecting in the borehole thermal neutrons or capture gamma rays resulting from nuclear reactions in the borehole and the subterranean formation, utilizing the post-gravel-pack data set to determine the location of the gravel-pack particles;

correlating the location of the gravel-pack particles to a depth measurement of the borehole to provide a gravel-pack measurement; and comparing the gravel-pack measurement with the gravel-pack model to determine the quality and/or percent fill of the gravel-pack particles placed inside the casing.

53. The method of claim 52 wherein the obtaining the post-gravel-pack data set further comprises measuring a capture cross-section of a borehole component and a time gated count rate from borehole and formation decay, wherein the time gated count rate from borehole and formation decay is measured within a time gate interval more than 400 μsec after the end of the neutron pulse.

54. The method of claim 52 wherein the simulation utilizes field conditions of the borehole, the formation, and the casing to provide a gravel-pack model yielding magnitudes of anticipated changes in at least one of the capture cross-section of the borehole component and the time gated count rate from borehole and formation decay as a function of the modeled percent fill of the modeled gravel-pack particles hydraulically placed into a region inside the cased borehole.

55. A method for determining the location and height of frac-pack particles placed inside a casing of a cased borehole and in fracture(s) in a subterranean formation as a result of a frac-pack procedure, comprising:

utilizing a frac-pack slurry, comprising a liquid and frac-pack particles to hydraulically fracture the subterranean formation to generate a fracture and to place the particles into the fracture and also into a frac-pack zone portion of the cased borehole in the vicinity of the fracture, wherein all or a fraction of such frac-pack particles includes a thermal neutron absorbing material;

obtaining a post-frac-pack data set by:

(i) lowering into the borehole traversing the subterranean formation a pulsed neutron capture logging tool comprising a pulsed neutron source and a detector, (ii) emitting pulses of neutrons from the last-mentioned neutron source into the borehole and the subterranean formation, (iii) detecting in the borehole thermal neutrons or capture gamma rays resulting from nuclear reactions in the borehole and the subterranean formation utilizing the post-frac-pack data set to determine the location of the frac-pack particles inside the casing;

and correlating the location of the frac-pack particles to a depth measurement of the borehole to determine at least one selected from the group consisting of the location, axial distribution, radial distribution, and height of frac-pack particles placed inside the casing borehole region in the vicinity of the fracture and to assist in determining the location and height of fracture(s) in the formation.

56. A method for determining the location and height of gravel-pack particles placed in a gravel-pack zone inside a casing of a cased borehole within a subterranean formation as a result of a gravel-pack procedure, comprising:

utilizing a gravel-pack slurry comprising a liquid and gravel-pack particles to hydraulically place the particles into a region of the cased borehole, wherein all or a fraction of such gravel-pack particles includes a thermal neutron absorbing material;

obtaining a post-gravel-pack data set by:

(i) lowering into the borehole traversing a subterranean formation a pulsed neutron capture logging tool comprising a pulsed neutron source and a detector, (ii) emitting pulses of neutrons from the last-mentioned neutron source into the borehole and the subterranean formation, (iii) detecting m the borehole thermal neutrons or capture gamma rays resulting from nuclear reactions in the borehole and the subterranean formation, utilizing the post-gravel-pack data set to determine the location of the gravel-pack particles; and correlating the location of the gravel-pack particles to a depth measurement of the borehole to determine the location, height, and/or percent fill of gravel-pack particles placed in the gravel-pack zone inside the casing.

* * * * *